US006035465A

United States Patent [19]

Rogozinski

[11] Patent Number: 6,035,465

[45] Date of Patent: Mar. 14, 2000

[54] PATIENT LIFTING AND SUPPORT SYSTEM

[75] Inventor: Joseph Rogozinski, Ramat Gan, Israel

[73] Assignee: Elliot Kelman, Antwerp, Belgium; a part interest

[21] Appl. No.: 08/849,161

[22] PCT Filed: Nov. 14, 1995

[86] PCT No.: PCT/GB95/02676

§ 371 Date: Oct. 15, 1997

§ 102(e) Date: Oct. 15, 1997

[87] PCT Pub. No.: WO96/14818

PCT Pub. Date: May 23, 1996

[30] Foreign Application Priority Data

Nov. 14, 1994 [IL] Israel ..... 111636

[51] Int. Cl.[7] ..... A61G 7/14

[52] U.S. Cl. ..... 5/83.1; 5/87.1; 5/85.1; 5/89.1; 5/86.1

[58] Field of Search ..... 5/81.1 R, 83.1, 5/84.1, 85.1, 87.1, 89.1, 86.1

[56] References Cited

U.S. PATENT DOCUMENTS

| | | | |
|---|---|---|---|
| 274,527 | 3/1883 | Stelle et al. . | |
| 841,702 | 3/1907 | Martin . | |
| 1,059,815 | 3/1913 | Belles . | |
| 1,072,959 | 9/1913 | Kincannon . | |
| 1,694,084 | 4/1928 | Straight . | |
| 2,636,188 | 4/1953 | Lockey . | |
| 2,846,091 | 8/1958 | Hefner . | |
| 3,282,362 | 11/1966 | Burns . | |
| 3,721,437 | 3/1973 | Skaricic | 272/70.3 |
| 3,780,663 | 12/1973 | Pettit | 104/1 R |
| 4,202,063 | 5/1980 | Murray | 5/87.1 |
| 4,243,147 | 1/1981 | Twitchell et al. | 212/159 |
| 4,256,098 | 3/1981 | Swan et al. | 128/133 |
| 4,410,175 | 10/1983 | Shamp | 272/70 |
| 4,545,575 | 10/1985 | Forjot | 272/97 |
| 4,721,182 | 1/1988 | Brinkmann et al. | 182/3 |
| 4,905,989 | 3/1990 | Colvin et al. | 272/70 |
| 4,907,571 | 3/1990 | Futakami | 128/25 R |
| 4,911,426 | 3/1990 | Scales | 272/70 |
| 4,944,056 | 7/1990 | Schroeder et al. | 5/85.1 |
| 4,948,118 | 8/1990 | Miraglia | 272/71 |
| 4,973,044 | 11/1990 | Jones | 272/70.3 |
| 4,999,862 | 3/1991 | Hefty | 5/87.1 |
| 5,077,844 | 1/1992 | Twitchell et al. | 272/232 |
| 5,117,516 | 6/1992 | Penner | 5/86.1 |
| 5,123,131 | 6/1992 | Jandrakovic | 5/81.1 |
| 5,147,051 | 9/1992 | Liljedahl | 212/214 |
| 5,185,895 | 2/1993 | Gagne et al. | 5/861.1 |
| 5,190,507 | 3/1993 | Iijima | 482/69 |
| 5,379,468 | 1/1995 | Cassidy . | |
| 5,511,256 | 4/1996 | Capaldi | 5/87.1 X |
| 5,530,976 | 7/1996 | Horcher | 5/89.1 |

FOREIGN PATENT DOCUMENTS

| | | |
|---|---|---|
| 0390003 | 10/1990 | European Pat. Off. . |
| 2403074 | 4/1979 | France . |
| 2414907 | 7/1979 | France . |

OTHER PUBLICATIONS

Burgar, Charles G., M.D. et al., NASA–ARC, Differential Walking Assist: An Inflatable Walking Support, 1994 Rehabilitation R&D Center Progress Report.

Dickstein, Ruth, D.Sc., et al., Self–Propelled Weight–Relieving Walker For Gait Rehabilitation, Journal of Bioimedical Engineering, vol. 14, Jul, 1992, pp. 351–355.

Pillar, Thomas M.D., et al., Walking Reduction With Partial Relief of Body Weight In Rehabilitation of Patients With Locomotor Disabilities, Journal of Rehabilitation R&D, vol. 28, No. 4, 1991, pp. 47–52.

*Primary Examiner*—Michael F. Trettel
*Attorney, Agent, or Firm*—Ladas & Parry

[57] ABSTRACT

Patient support apparatus comprising a patient support assembly, a winch for vertically displacing the patient support assembly, yieldable force application apparatus operative to apply a restraining force to the patient support assembly, and a displacement limiter operative to limit the vertical displacement of the patient support assembly in at least one direction.

7 Claims, 34 Drawing Sheets

FIG. 17
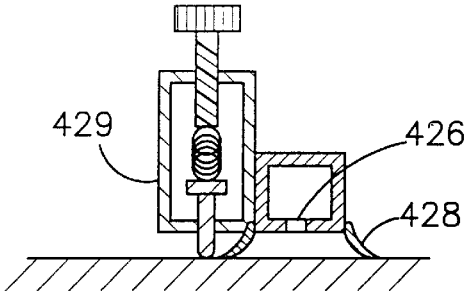
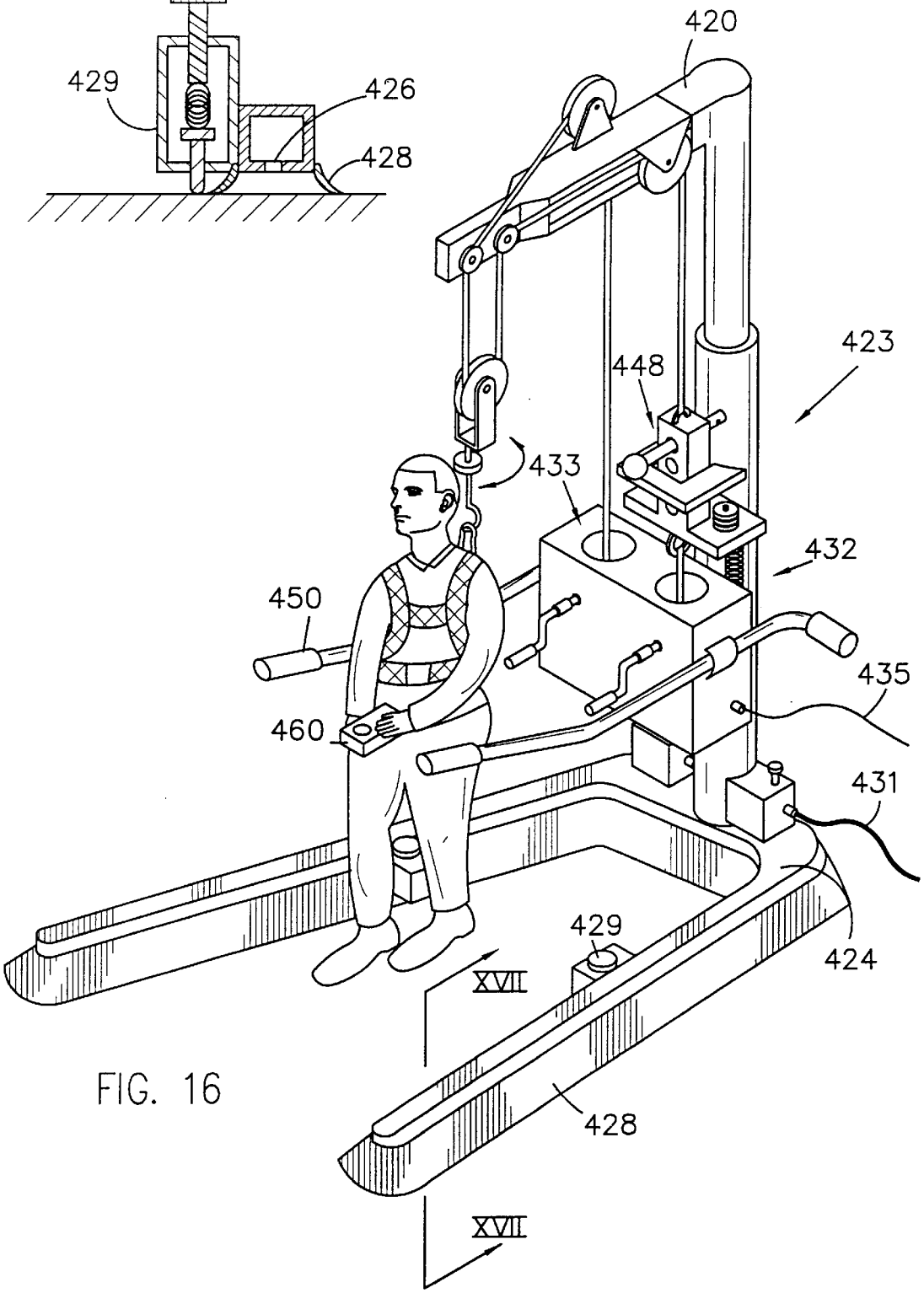
FIG. 16

850
874
856
870
858
860
864
862
871
853
852
866
868
XXXVII
XXXVI
XXXVI
XXXVII

PATIENT LIFTING AND SUPPORT SYSTEM

FIELD OF THE INVENTION

The present invention relates to patient lifting and support systems generally.

BACKGROUND OF THE INVENTION

There exists a wide variety of patient lift and support systems. The following U.S. Patents are believed to represent the state of the art: U.S. Pat. Nos. 274,527; 841,702; 1,072,959; 1,059,815; 1,694,084; 2,636,188; 2,846,091; 3,721,437; 3,780,663; 4,243,147; 4,256,098; 4,410,175; 4,545,575; 4,721,182; 4,905,989; 4,907,571; 4,911,426; 4,948,118; 4,973,044; 5,077,844; 5,123,131; 5,147,051; 5,185,895; 5,190,507.

SUMMARY OF THE INVENTION

The present invention seeks to provide improved patient support apparatus which greatly enhances the freedom of movement of patients without sacrificing safety considerations.

There is thus provided in accordance with a preferred embodiment of the present invention patient support apparatus including:

a patient support assembly;

a winch for vertically displacing the patient support assembly;

yieldable force application apparatus operative to apply a restraining force to the patient support assembly; and a displacement limiter operative to limit the vertical displacement of the patient support assembly in at least one direction. There as also provided in accordance with a preferred embodiment of the invention a force limiter for limiting the amount of force exerted by a patient when moving on a support surface.

In accordance with a preferred embodiment of the present invention the patient support assembly includes multiple patient engagement elements which are selectably arranged thereon for determining the configuration of the patient when supported.

Preferably, the patient support assembly is inflatable.

In accordance with a preferred embodiment of the present invention, the yieldable force application apparatus is connected in series with the winch.

Preferably, the displacement limiter includes a shock absorber.

In accordance with a preferred embodiment of the present invention, the patient support apparatus also includes a support arm. Preferably the support arm is pivotably supported for rotation in a horizontal plane and is associated with the winch.

In accordance with a preferred embodiment of the present invention, the patient support apparatus also includes a support arm rider which is displaceable along the support arm.

In accordance with a preferred embodiment of the present invention, the patient support apparatus also includes a cable which is selectably wound and tensioned at opposite ends thereof by the winch and by the yieldable force application apparatus respectively.

In accordance with a preferred embodiment of the invention there is provided a patient operable control of the winch and the yieldable force application apparatus.

Preferably, the winch and the yieldable force application apparatus are located at a fixed location.

Preferably, the patient support apparatus also includes a movable frame onto which the patient engagement assembly, the winch and the yieldable force application apparatus are supported.

In accordance with a preferred embodiment of the present invention the patient support apparatus is operative in accordance with at least one, more preferably two, even more preferably three and most preferably all of the following operational modes: RIGID, SELECTABLE FIXED TENSION, VARIABLE TENSION and PROGRAMMED RAISE/LOWER.

Preferably, the RIGID mode is characterized in that a desired vertical position of the patient engagement assembly is maintained, notwithstanding variations in the vertical tension applied thereto.

Preferably, the SELECTABLE FIXED TENSION mode is characterized in that a desired vertical tension is applied to the patient engagement assembly.

Preferably, the VARIABLE TENSION mode is characterized in that the vertical tension applied to the patient engagement assembly varies as a function of the vertical position thereof within selectable limits.

In accordance with a preferred embodiment of the present invention, the PROGRAMMED RAISE/LOWER mode is characterized in that a vertical force is periodically applied to the patient engagement assembly in a selectably preprogrammed manner, as for providing exercise to particular parts of a patient's body.

Preferably, the patient support apparatus is also characterized in that it comprises a safety limiting function which includes mechanical stoppers.

Preferably, the patient support apparatus is also characterized in that it provides a safety limiting function, which automatically limits the permitted fall of a patient.

In accordance with a preferred embodiment of the invention, the safety limiting function is capable of being overridden by a key operated mechanism accessible only to authorized care personnel.

Preferably, the yieldable force application apparatus is operative in an automatic centering mode of operation wherein a potentiometer senses whether parts of the yieldable force application apparatus are outside of a defined range of positions and automatically applies a force thereto for relocating them back within the defined range of positions. Additionally in accordance with a preferred embodiment of the present invention there is provided an air cushion patient support assembly comprising a patient support appliance, at least one inflatable enclosure member disposed between the patient support appliance and a support surface and a pressurized air source providing pressurized air to the interior of the enclosure member and to a region enclosed thereby and disposed between the patient support appliance and the support surface, thereby creating an air cushion. Additionally in accordance with a preferred embodiment of the present invention there is provided an air cushion patient support assembly including a patient support appliance, at least one inflatable enclosure member disposed between the patient support appliance and a support surface, and a pressurized air source providing pressurized air to a region enclosed by the at least one inflatable enclosure member and disposed between the patient support appliance and the support surface, thereby creating an air cushion.

The pressurized air source may be coupled to the interior of the enclosure member or alternatively or additionally to the enclosure member.

In accordance with a preferred embodiment of the present invention the at least one inflatable enclosure member includes an outer inflatable enclosure member and a plurality of interior inflatable enclosure members disposed therewithin.

Further in accordance with an embodiment of the present invention, the assembly may include a pressurized air reservoir mounted on the at least one inflatable enclosure member for movement therewith.

Further in accordance with an embodiment of the present invention, the assembly may include at least one inflatable enclosure member comprising an outer inflatable enclosure member and a castor assembly.

Additionally in accordance with an embodiment of the present invention, the assembly may include a pressurized air compressor mounted on the at least one inflatable enclosure member for movement therewith.

Alternatively, pressurized air may be provided to the assembly via one or more flexible hoses.

Additionally, in accordance with a preferred embodiment of the invention, methods of patient support are provided as described hereinbelow and shown in the drawings.

BRIEF DESCRIPTION OF THE DRAWINGS

The present invention will be understood and appreciated more fully from the following detailed description, taken in conjunction with the drawings in which:

FIGS. 15 and 16 illustrate two alternative embodiments of a portable patient lifting and support system constructed and operative in accordance with preferred embodiments of the present invention;

FIG. 17 is a sectional illustration of part of the apparatus of FIG. 16, taken along lines XVII—XVII in FIG. 16;

DETAILED DESCRIPTION OF A PREFERRED EMBODIMENT

Figure 1:
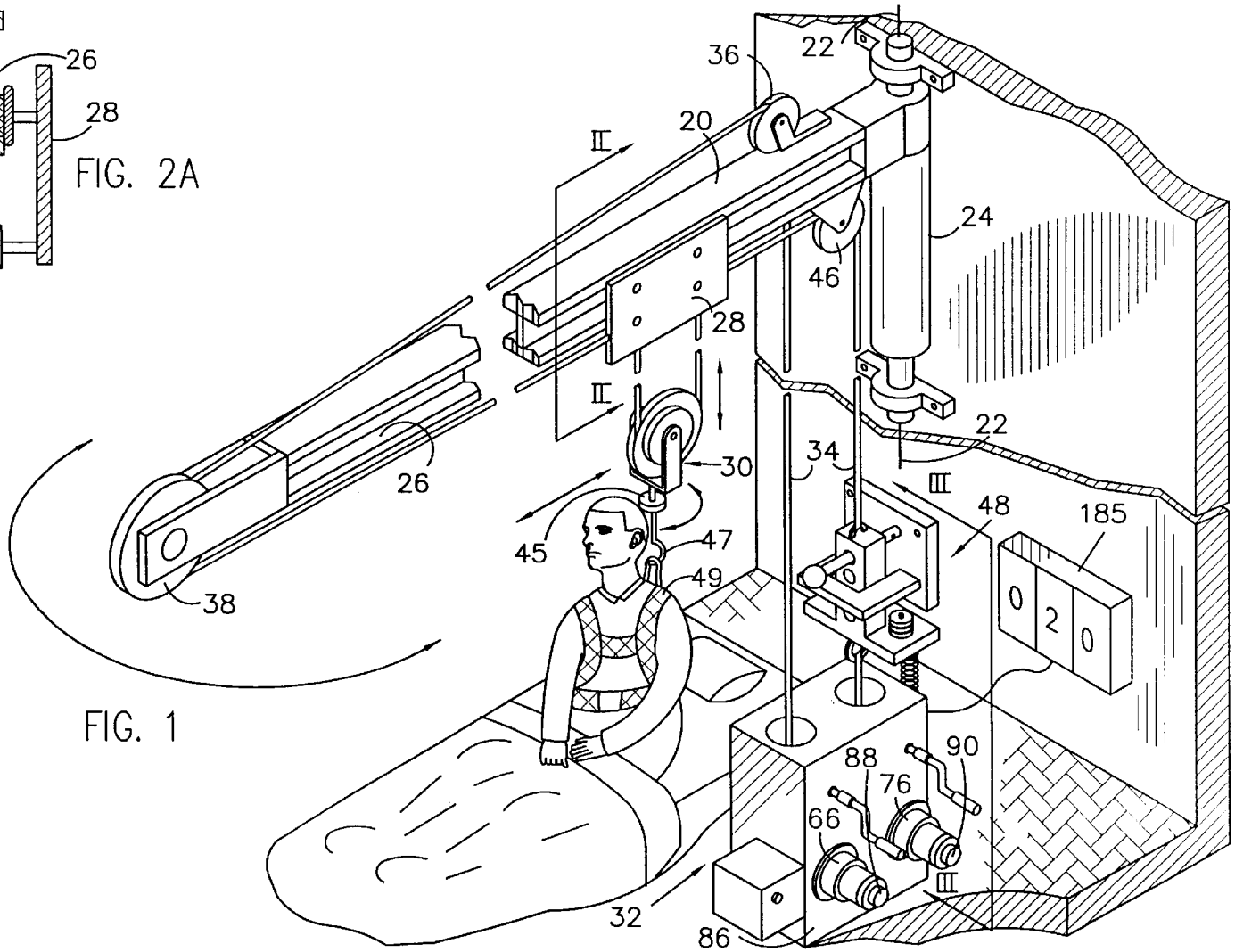
FIG. 1 is a pictorial illustration of a patient lifting and support system constructed and operative in accordance with a preferred embodiment of the present invention.

Reference is now made to FIGS. 1–4, which illustrate a patient lifting and support system constructed and operative in accordance with a preferred embodiment of the present invention. The system comprises a support arm 20 which is pivotably supported for rotation in a horizontal plane about a generally vertical axis 22. Axis 22 is typically defined by a wall or post mounted axle assembly 24 which provides, in principle, the possibility of rotation through 360 degrees.

Support arm 20 defines a generally horizontal track 26 along which a rider assembly 28 is slidably movable, so as thus to be radially positionable along the track 26 at an azimuth determined by the rotational orientation of arm 20.

Figure 2A:
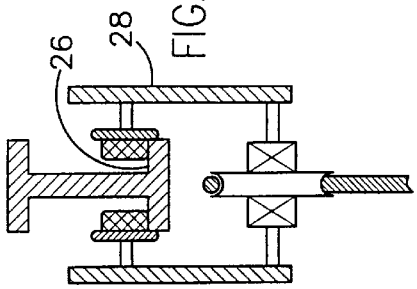
FIG. 2A is a sectional illustration taken along the lines II—II in FIG. 1.

A patient engagement assembly 30 is operatively associated with rider assembly 28 and with support arm 20 by means of a pulley and cable system which will now be described, with particular reference to FIGS. 2A, 2B and 3A. It is a particular feature of the present invention that rider assembly 28 is relatively free to slide along track 26 independently of operation and operative orientation of the pulley and cable system.

The pulley and cable system comprises winch apparatus 32, which may be manually or electrically controlled, as will be described hereinbelow. Winch apparatus 32 engages one end of a cable 34 which extends over a pulley 36 mounted onto support arm 20 at a location adjacent to axis 22. The cable 34 proceeds to be looped around a pulley 38, which is disposed adjacent an extreme outward end of support arm 20 and then is directed radially inwardly, generally parallel to support arm 20, where it passes over a pair of pulleys 40 and 42 of rider assembly 28.

Over intermediate pulleys 40 and 42, the cable 34 loops downward and is engaged by a pulley 44, forming part of patient engagement assembly 30, which is supported on cable 34 via pulley 44. The cable proceeds from pulley 42 to a pulley 46, mounted on arm 20 and then loops thereover downward into fixed engagement with an adjustable shock absorbing, travel limiting and loading assembly 48, which will be described hereinbelow in detail.

The patient engagement assembly 30 typically includes, in addition to pulley 44, a rotation bearing 45 and a hook or other fastener 47, which can be removably coupled to a patient harness 49 or other support device.

Figure 3:
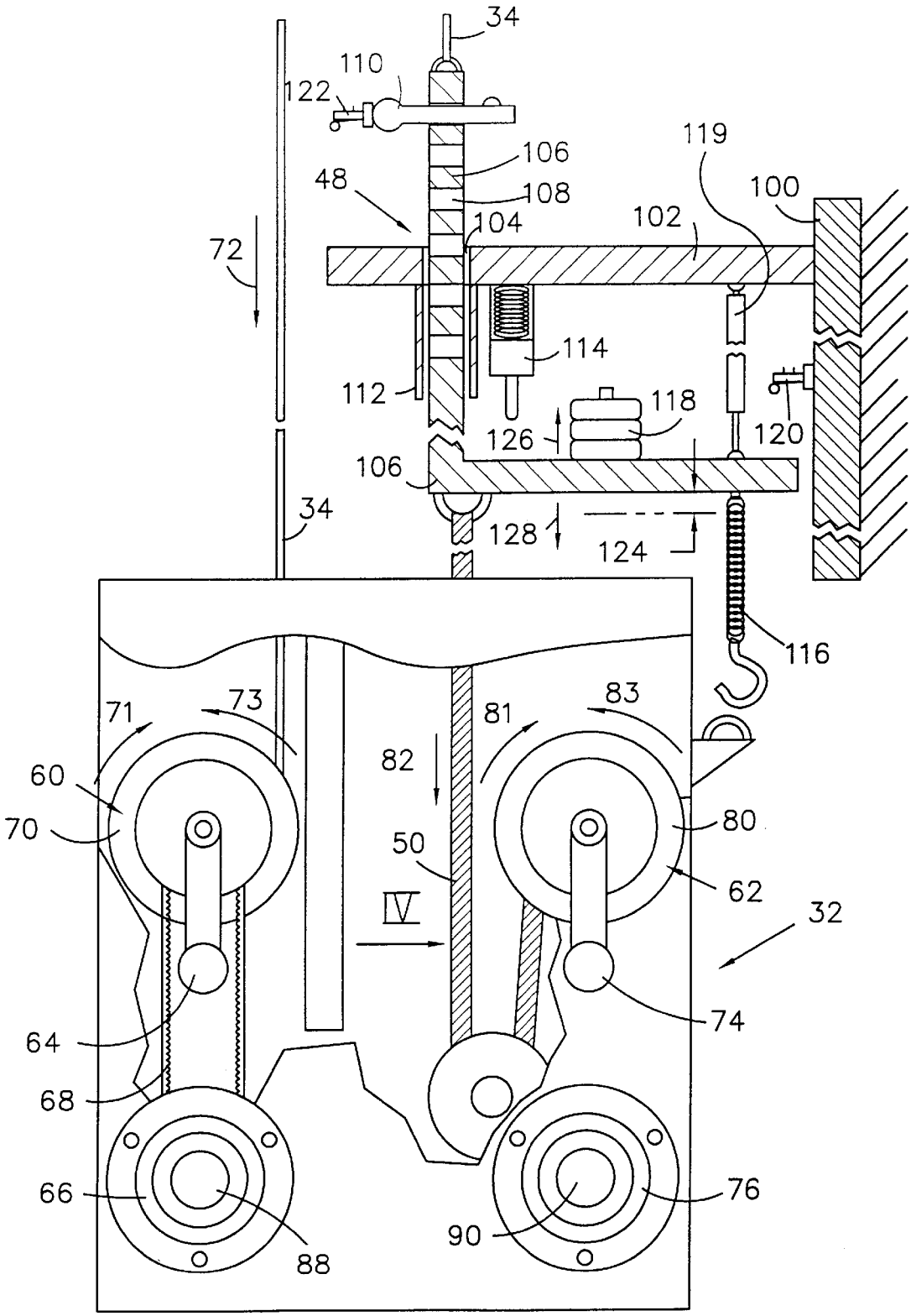
FIG. 3 is a partially sectional, partially cut-away side view illustration of part of the apparatus of FIG. 1, taken along lines III—III in FIG. 1.

As seen in FIG. 3, a resiliently extendible secondary cable 50 interconnects an assembly 48 with winch apparatus 32. Winch apparatus 32 includes a pair of cable winding assemblies 60 and 62. Assembly 60 includes a hand crank 64 and an electric motor 66 coupled thereto as by a belt 68, which is arranged so as to permit winding of cable 34 onto a winding drum 70, coupled thereto by a gear assembly (not shown in FIG. 3) to a desired extent by operation of either the hand crank 64 or the electric motor 66. A suitable clutch (not shown in FIG. 3), such as that employed in lathes, may be employed to prevent undesired motion of the hand crank 64, when the cable 34 is being wound or unwound by the electric motor 66.

For clarity, the direction of rotation of the drum 70 for winding of the cable 34 thereon is indicated by an arrow 71. The direction of travel of the cable 34 as it is being wound on drum 70 is indicated by an arrow 72.

Figure 4:
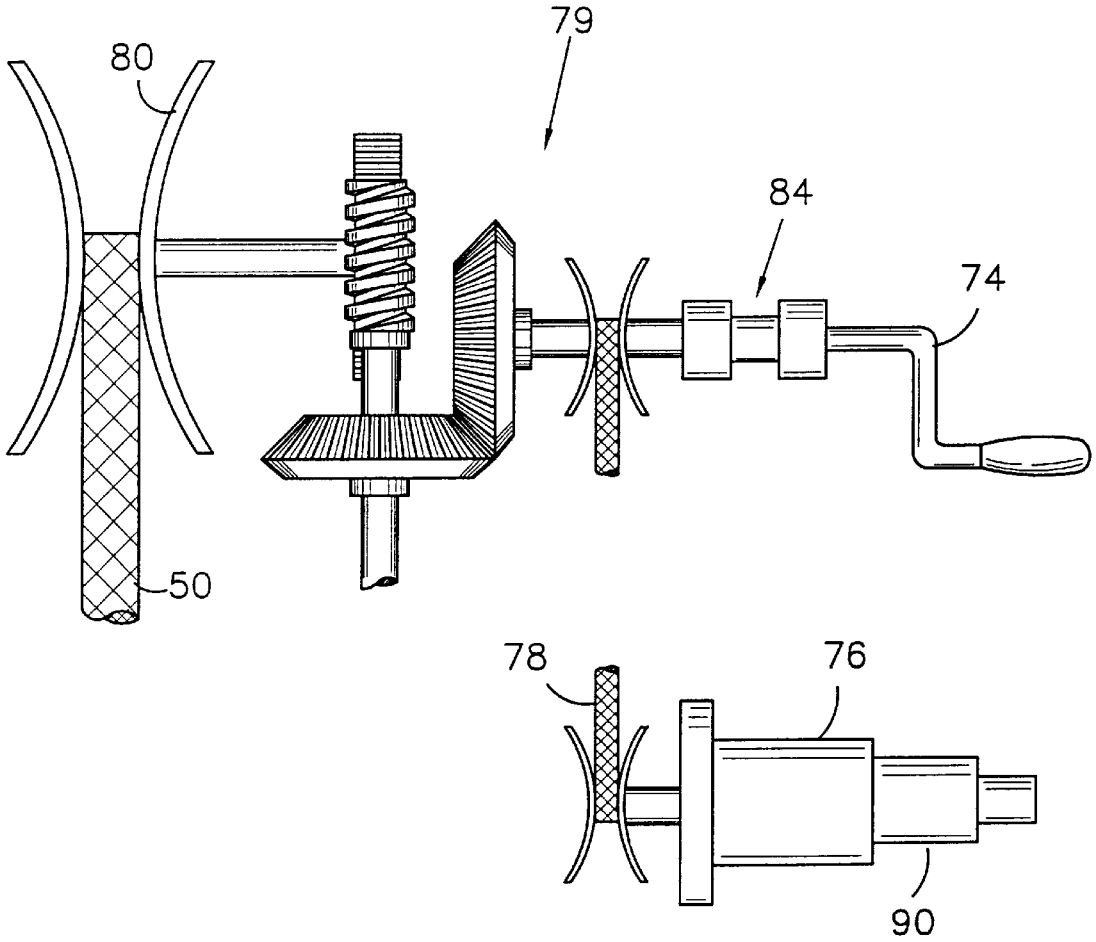
FIG. 4 is a simplified illustration of a portion of the apparatus of FIG. 3, taken in a direction indicated by an arrow IV in FIG. 3.

Assembly 62, which is also illustrated in FIG. 4, and is essentially similar to assembly 60, includes a hand crank 74 and an electric motor 76 coupled thereto as by a belt 78, which is arranged so as to permit winding of secondary cable 50 onto a winding drum 80, coupled thereto by a gear assembly 79, to a desired extent by operation of either the hand crank 74 or the electric motor 76. A suitable clutch 84, such as that employed in lathes, may be employed to prevent undesired motion of the hand crank 74, when the cable 78 is being wound or unwound by the electric motor 76.

For clarity, the direction of rotation of the drum 80 for winding of the cable 50, which will pull cable 34 thereon is indicated by an arrow 81. The direction of travel of the secondary cable 50 as it is being wound on drum 80 is indicated by an arrow 82.

Electric motors 66 and 76 may be controlled by any suitable controller, which may be housed in an enclosure 86 (FIG. 1) and may cooperate with corresponding resolvers 88 and 90 associated with respective motors 66 and 76 (FIG. 1).

It is appreciated that winding of cable 34 onto winding drum 70 effectively shortens the cable 34 and thus raises the patient engagement assembly 30. Similarly, unwinding of the cable 34 from drum 70 effectively lengthens the cable 34 and thus lowers the patient engagement assembly 30. The radial position of the patient engagement assembly 30 is independent of its height and may be determined by merely sliding the rider 28 along track 26.

Adjustable assembly 48 preferably comprises a base 100 which may be fixed to a wall or other secure fixture and which is preferably formed with a generally horizontally extending portion 102, having an aperture 104 firmed therein. A cable connecting element 106, typically having a generally L-shaped configuration is coupled at its top to cable 34 and at its bottom to secondary cable 50. An vertically extending portion of element 106 extends through aperture 104.

Cable connecting element 106 may be formed with a plurality of apertures 108 cooperative with a selectably positionable pin 110 for absolutely limiting the amount of downward displacement of element 106. The amount of upward displacement of element 106, which, as will be described hereinbelow, corresponds to the amount that a patient may be allowed to fall, is limited by a guide and spacer element 112 that is mounted onto the underside of portion 102.

It is a particular feature of the present invention that in the event of a patient falling, the fail is broken in a manner so as to minimize physical shock or impact to the patient. The required shock absorption is provided by a shock absorber 114, which is typically mounted on the underside of portion 102, so as to be engaged by a horizontal portion of element 106 as it moves upward within a predetermined range of displacements. Additional shock absorption may be provided by a tension spring 116, which may interconnect element 106 and any fixed anchor, such as the housing of winch 32, as shown in FIG. 3.

Pretensioning of cable 34 may be provided by the placement of suitable weights 118 on element 106, as shown. Alternatively or additionally, such pretensioning may be provided by spring 116. A linear sensor, preferably a linear potentiometer 119, provides an output indication of the position of element 106 relative to horizontally expending portion 102. A microswitch 120 may be mounted on base 100 and another microswitch 122 may be mounted on pin 110 so as to indicate to a control apparatus, described hereinbelow with respect to FIG. 18, that the element 106 is positioned adjacent one of its extreme displacement limits.

Preferably, for every suitable position of pin 110 along element 106, there is defined a vertical range, here indicated by reference numeral 124, within which vertical movement of element 106 relative to extending portion 102 does not provoke any response by the control apparatus. It is desired that element 106 normally lie approximately at the center of vertical range 124. Upward movement of element 106 relative to portion 102 is indicated by an arrow 126, while downward movement of element 106 is indicated by an arrow 128.

Figure 7:
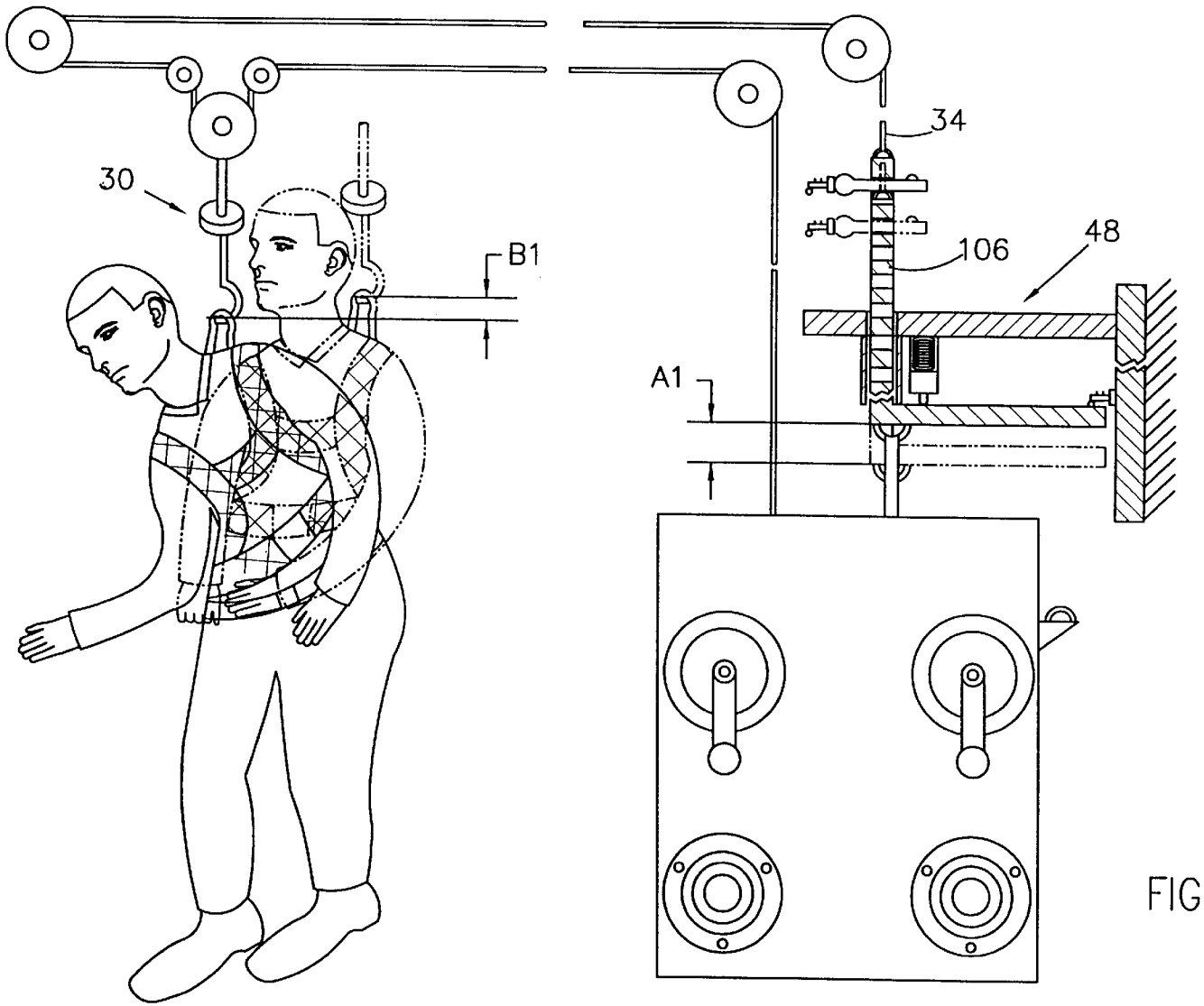
FIG. 7 is a pictorial illustration showing a support function provided by the apparatus of FIGS. 1–6.

Reference is now made to FIG. 7, which illustrates the operation of the apparatus of FIGS. 1–4. Should a patient fall, as illustrated in FIG. 7, the displacement of the cable 34 is twice the displacement of the patient engagement assembly 30. Thus, if assembly 48 limits the displacement of the cable 34 to a distance A1, the total vertical patient displacement permitted is one half of A1, here indicated as B1.

Figure 5:
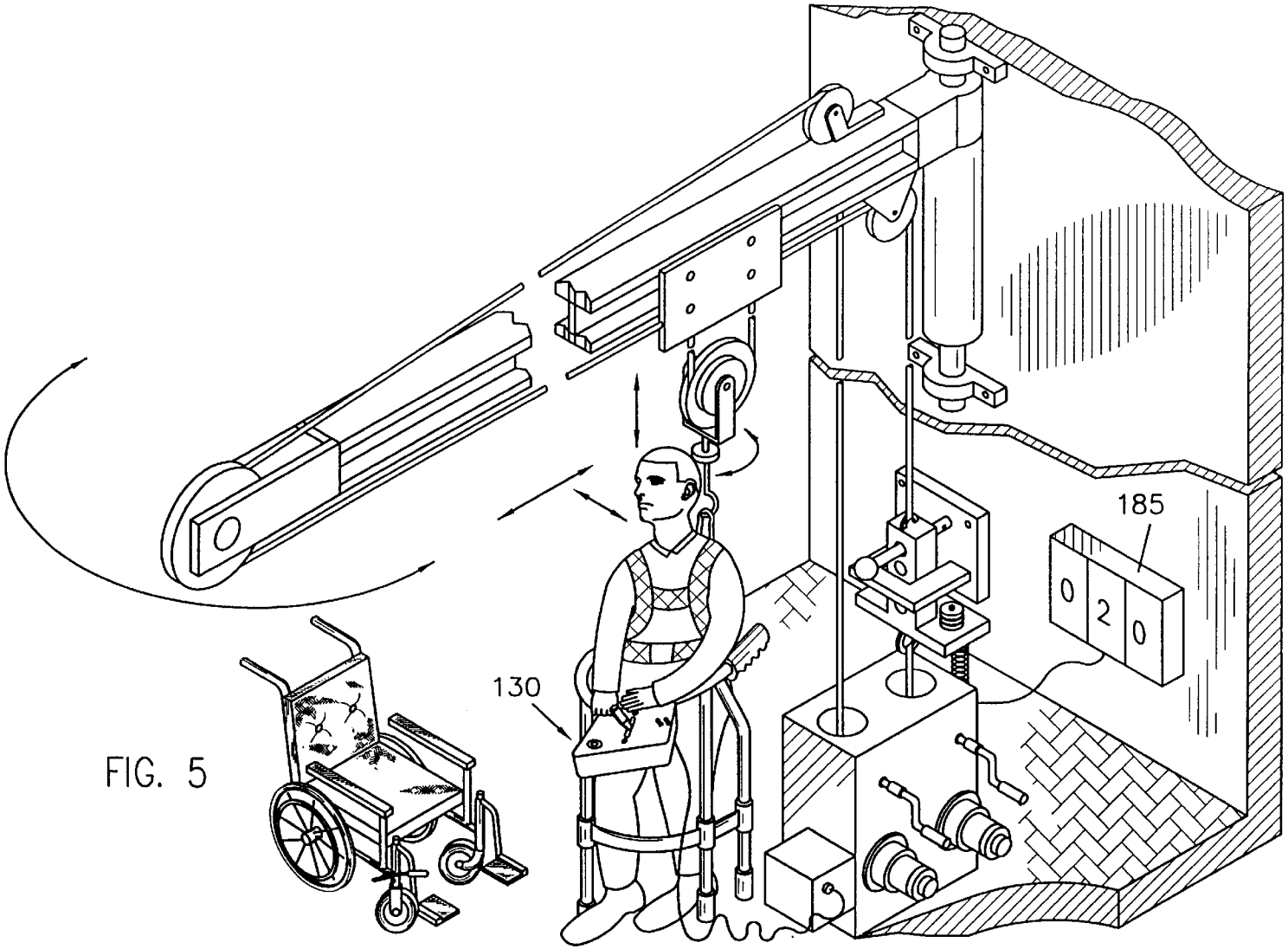
FIG. 5 is a pictorial illustration of a patient lifting and support system constructed and operative in accordance with another preferred embodiment of the present invention.
Figure 6:
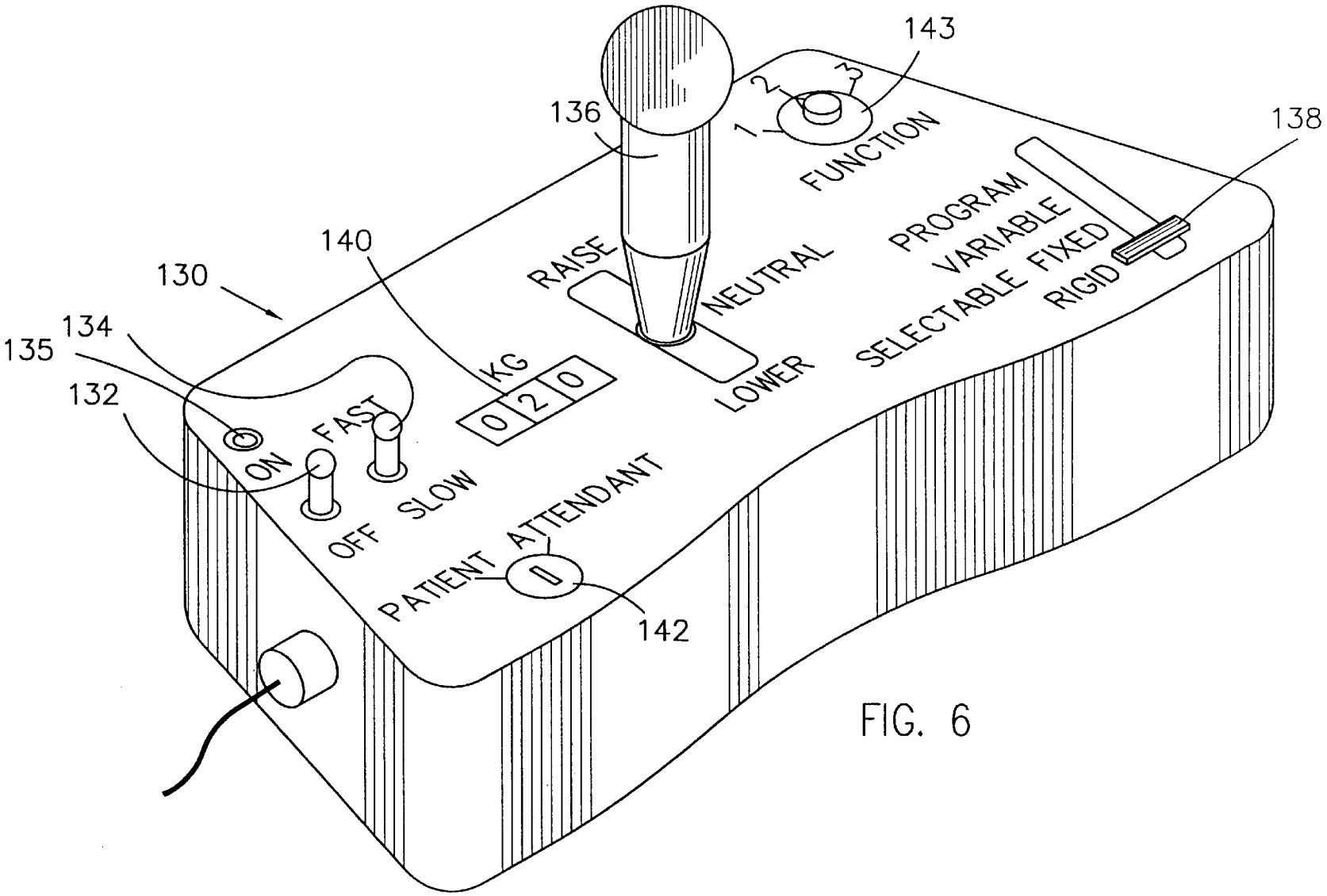
FIG. 6 is a pictorial illustration of a control input device forming part of the apparatus of FIG. 5.

Reference is now made to FIG. 5, which illustrates apparatus identical to that of FIG. 1 with the addition of a patient operable control unit 130. A preferred embodiment of such a unit is shown in FIG. 6 where it is seen that the unit preferably has a joystick type configuration as well as switches 132 and 134 for determining ON-OFF status of the patient support apparatus, and the rate of change of operational parameters, e.g. FAST-SLOW. An illuminated indicator 135 indicates that the patient support apparatus is ON.

A joystick handle 136 preferably has two operative orientations, indicated as RAISE and LOWER, as well as a NEUTRAL orientation, disposed therebetween, which is the default orientation. An operational control switch 138 has four selectable positions, corresponding to modes of operation indicated as RIGID, SELECTABLE FIXED TENSION, VARIABLE TENSION, and PROGRAMMED RAISE/LOWER. An indicator 140 may provide a readily viewable output indication of the tension applied to patient engagement assembly 30 along cable 34. A key operated switch 142 may provide an override function restricted to authorized attendants which overrides limitations on vertical movements of the patient. A function control switch 143, whose purpose will be described hereinbelow, is also provided.

Figure 8:
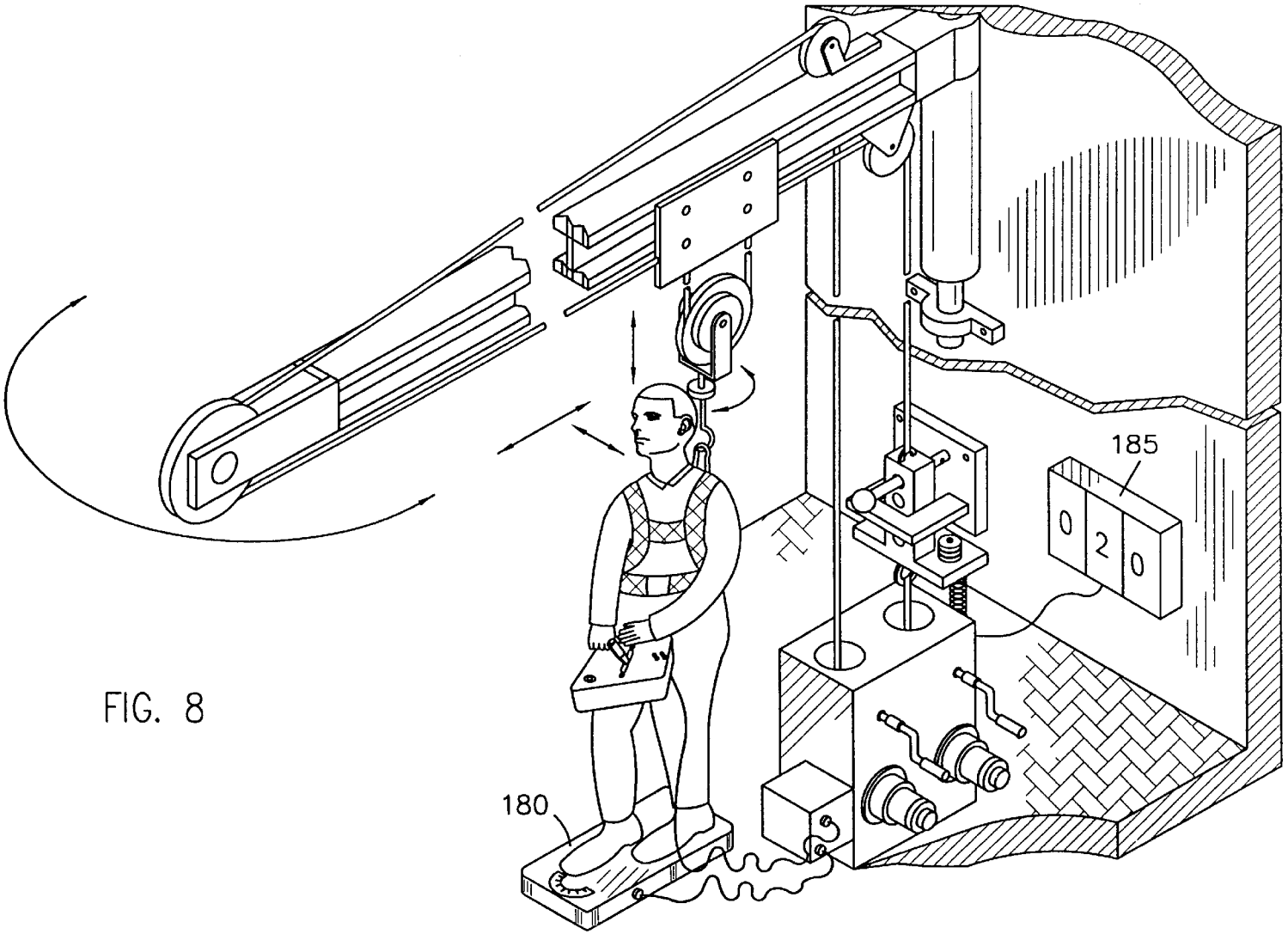
FIG. 8 is a pictorial illustration of calibration of the patient lifting and support system of FIGS. 5–7.

FIG. 8 illustrates one possible method of calibration of the system shown in FIG. 5 wherein the weight of the user is measured and taken into account in determining the tension on cable 34. An electronic scale 180 may provide an output directly to the control circuitry for such calibration. Alternatively, the patient's weight may be taken into account in another manner. A display 185, as shown in FIGS. 1, 5 and 8, may be provided to indicate the force which the patient applies to the scale 180.

Figure 9:
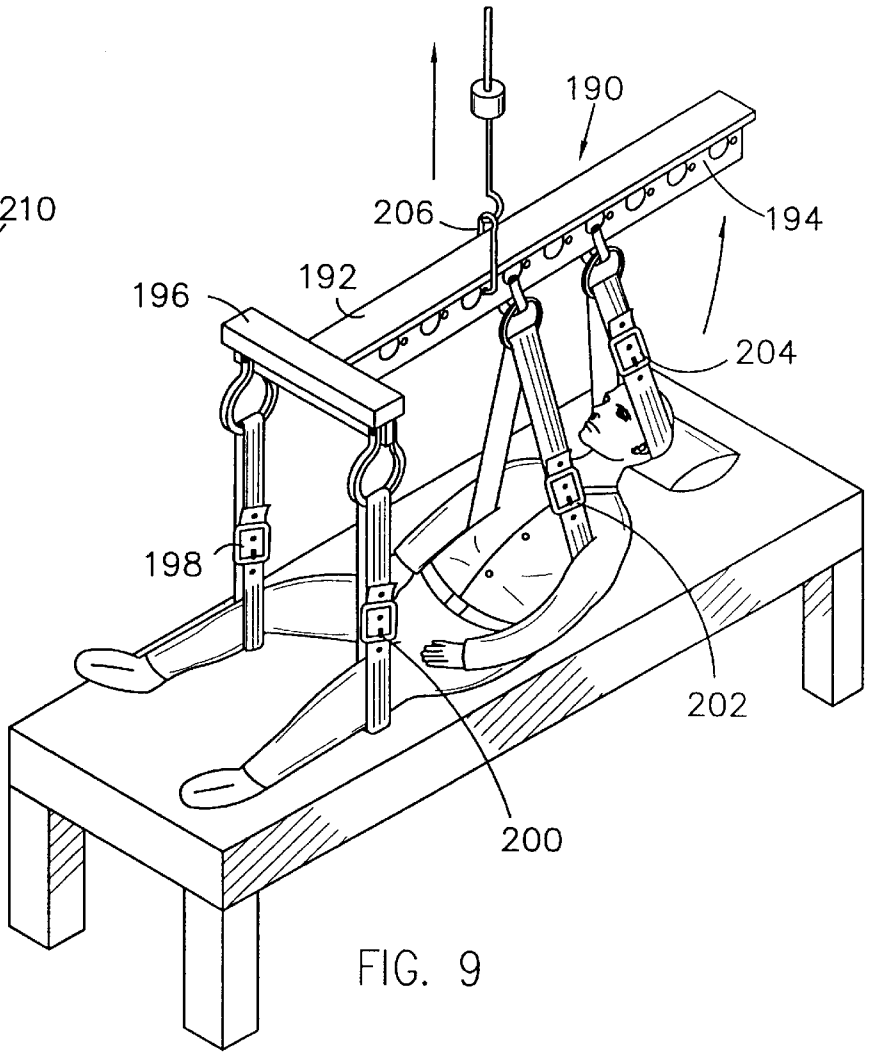
FIGS. 9 and 10 are pictorial illustrations showing apparatus useful with the system of FIGS. 1–4, for lifting and moving generally prone patients.
Figure 10:
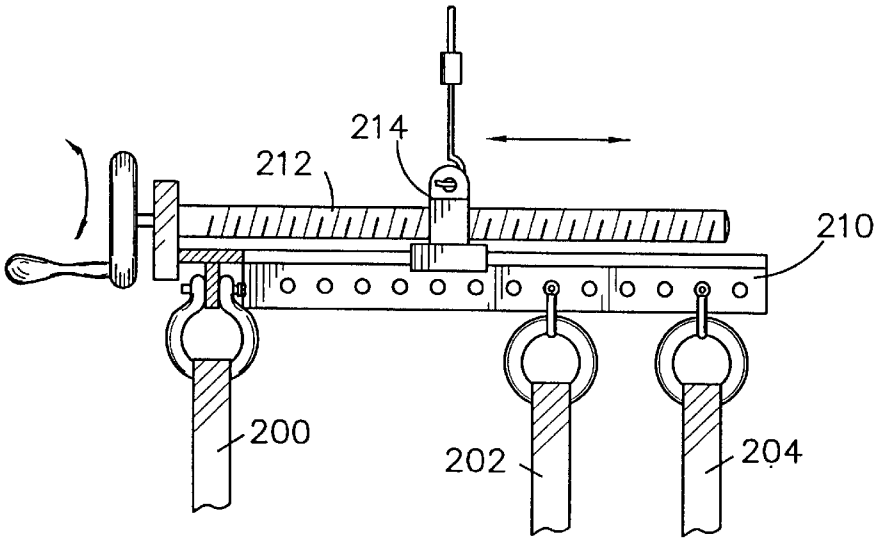

Reference is now made to FIGS. 9 and 10 which illustrate apparatus for lifting a generally prone patient. The apparatus of FIG. 9, which may be connected to the patient engagement assembly 30 (FIG. 1) typically comprises a frame 190 typically including a longitudinal portion 192 formed with a linear array of mounting apertures or other appendages 194 as well as a cross beam 196.

Leg support straps 198 and 200 are typically mounted on cross beam 196, while body and head support straps 202 and 204, respectively, are mounted at desired locations along longitudinal portion 192, as shown. The frame 190 is supported onto patient engagement assembly 30 at a location along frame 190 which is selected in accordance with the center of gravity of the patient and is determined by engagement of the patient engagement assembly 30 with a suitable one of the array of mounting apertures or other appendages 194, by means of a suitable connector 206, as shown.

Reference is now made to FIG. 10, which illustrates a somewhat different embodiment of the apparatus of FIG. 9. Here the location of the attachment of the patient engagement assembly 30 to the corresponding frame 210 is determined by a crank operated screw assembly 212 onto which a threaded connector 214 is mounted for selectable positioning thereof.

Figure 11A:
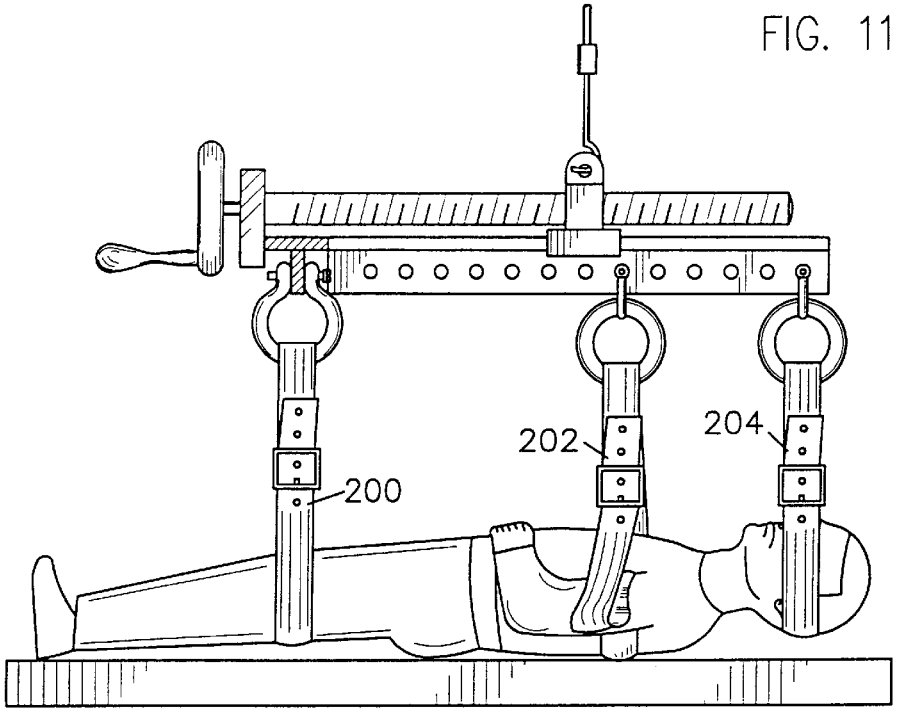
FIGS. 11A and 11B illustrate the use of the apparatus of FIGS. 9 and 10 for lifting a patient in a generally prone but non-planar orientation.
Figure 11B:
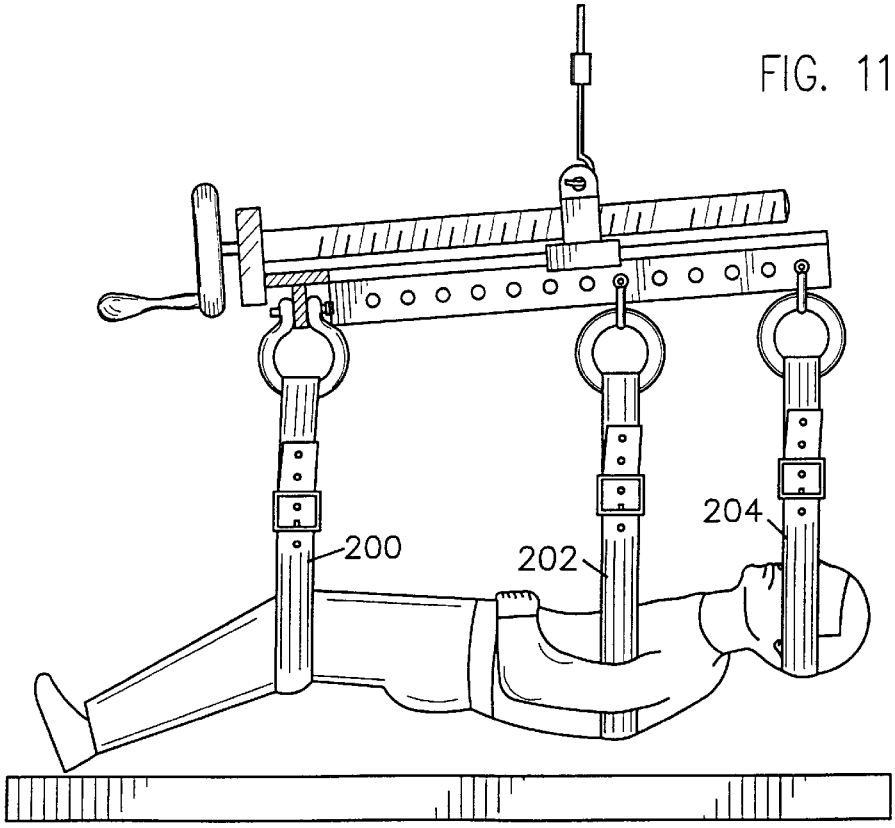

Reference is now made to FIGS. 11A and 11B, which illustrate use of the apparatus of FIG. 10 for lifting a prone patient in a non-planar manner so as to enable various exercises and motions of parts of the patient's body to be carried out, either by the patient or by auxiliary personnel. It is seen that suitable adjustment or selection of the length and positions of straps 200, 202 and 204 is effective for providing a desired lift configuration. It will be appreciated that the apparatus of FIGS. 9 and 10 may also be employed for supporting a person in a standing orientation and enables selection of the proportion of the person's weight which is carried by each of his legs.

Figure 13:
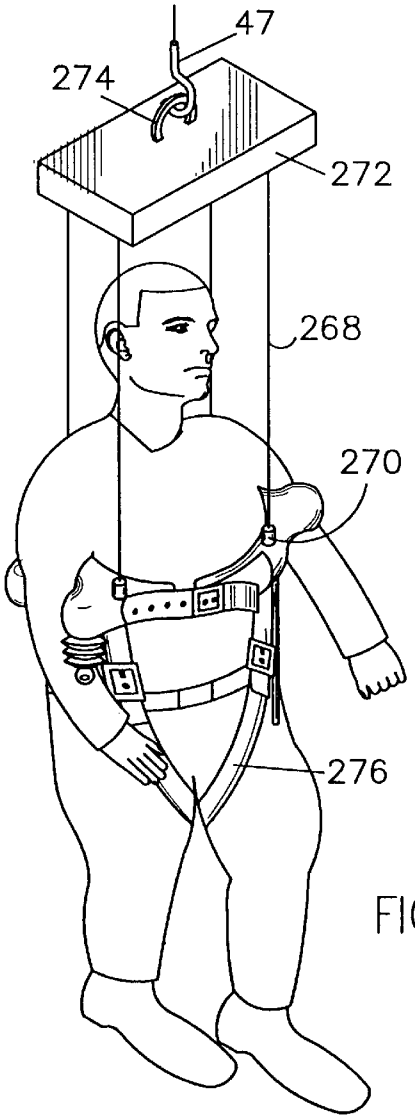
FIGS. 12 and 13 illustrate the structure and operation of an inflated patient support appliance useful with the apparatus of FIGS. 1–10.
Figure 12:
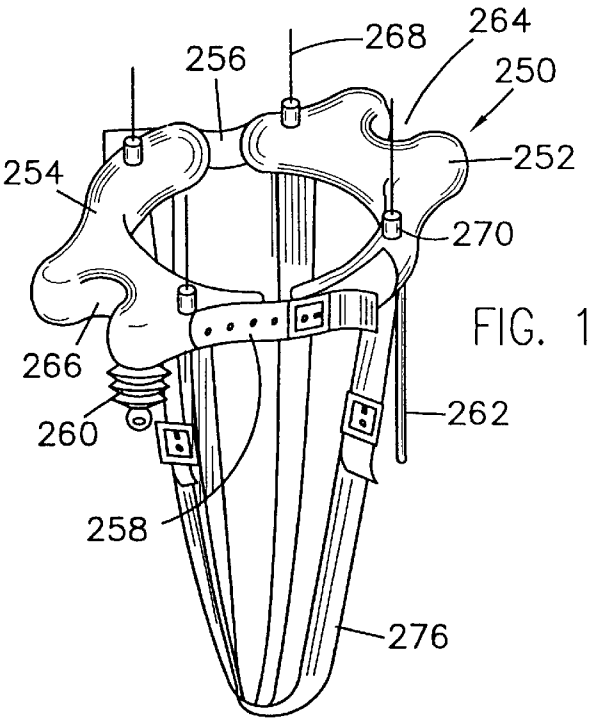

Reference is now made to FIGS. 12 and 13 which illustrate the structure and operation of an inflated patient support appliance useful with the apparatus of FIGS. 1–10, 14–16. The inflated patient support appliance comprises an inflatable body engagement assembly 250, which typically comprises a pair of symmetric inflatable side elements 252 and 254, which are joined by rear and forward adjustable straps 256 and 258, respectively. Side elements 252 and 254 may be provided with pumps 260 and/or mouthpieces 262 for inflation purposes. Assembly 250 is designed to snugly fit a user and to provide support for his arms at recesses 264 and 266.

Side elements 252 and 254 are supported from above by four cables 268, which engage the side elements at anchors 270 and are in turn supported on a base member 272, which may be provided with a hook 274 or other mechanism for being connected to hook 47 (FIG. 1). Additional leg engagement straps 276 may also be provided.

Figure 14:
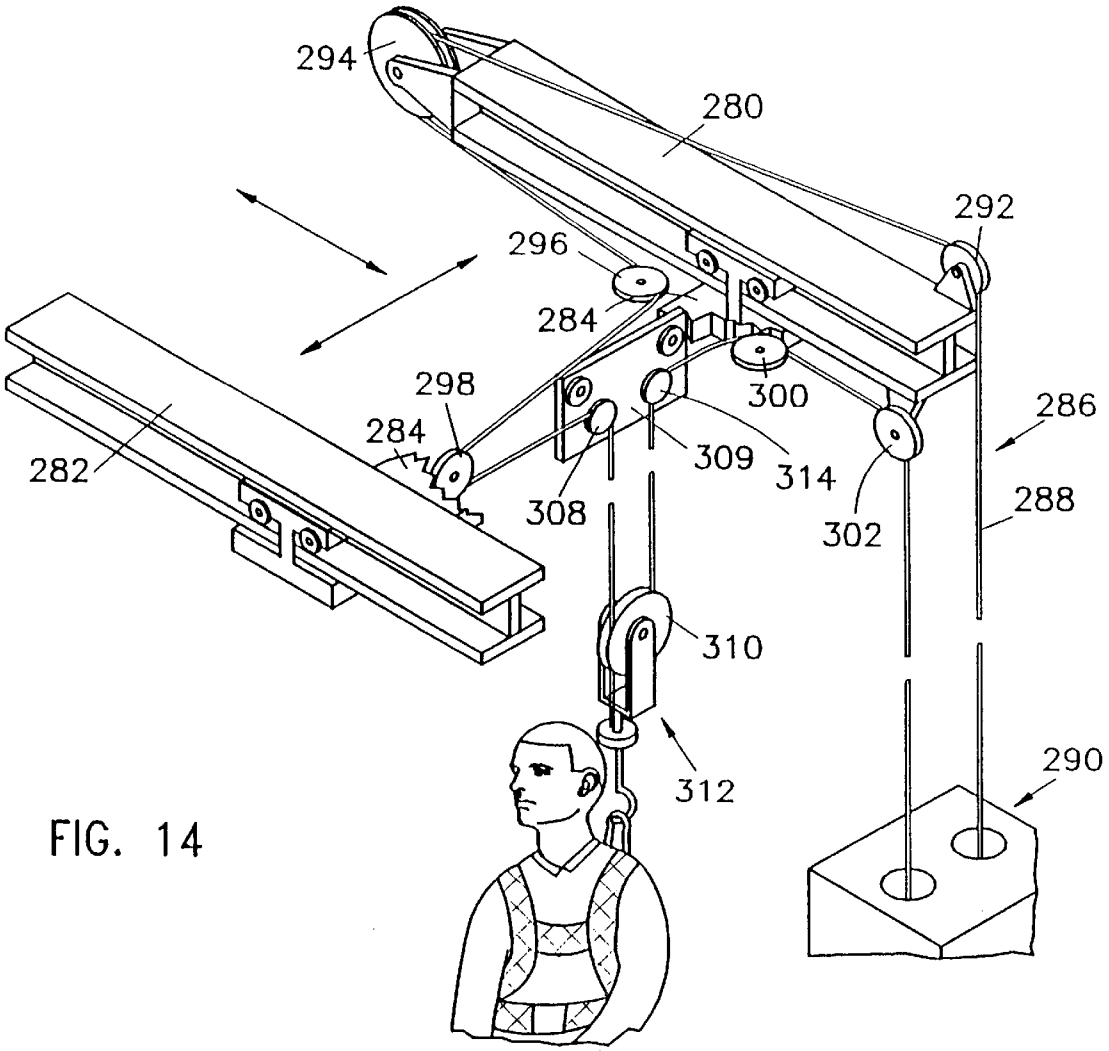
FIG. 14 is a simplified pictorial illustration of a variation of the apparatus of FIG. 1.

Reference is now made to FIG. 14, which illustrates an alternative structure for the patient lifting and support system of FIG. 1. In the embodiment of FIG. 14, a pair of rails 280 and 282 are fixedly mounted overhead in a room or other volume. As in conventional overhead cranes, a cross-beam support element 284 is mounted to extend between rails 280 and 282 and to selectably roll therealong.

In accordance with a preferred embodiment of the present invention, a cable and pulley system 286 is provided for selectable positioning of a patient. Assembly 286 includes a cable 288, which engages at both of its ends a winch assembly 290, which may be identical in structure and function to winch apparatus 32 of FIG. 1, and which typically includes cable winding assemblies which may be identical in structure and function to cable winding assemblies 60 and 62 (FIG. 3).

Cable 288 extends from winch assembly 290 over a pulley 292 which is fixed with respect to rail 280 adjacent a first end thereof. The cable 288 proceeds to be looped around a pulley 294, which is fixed adjacent an extreme outward end of rail 280, and then is directed back towards the first end of rail 280, generally parallel thereto, where it passes over a pulley 296, which is fixed with respect to cross-beam support element 284 adjacent rail 280. The cable proceeds to be looped around a pulley 298, which is also fixed with respect to cross-beam support element 284 and lies adjacent rail 282. The cable then proceeds to engage a pulley 300, which is also fixed to cross-beam support element 284, adjacent rail 280 and thence into engagement with a pulley 302, which is fixed with respect to rail 280, adjacent the first end thereof. The cable then engages winch assembly 290.

Intermediate pulleys 298 and 300, the cable 288 loops downward around a pulley 308 mounted on a rider assembly 309, which is slidably movable along cross-beam support element 284, and is engaged by a pulley 310, forming part of patient engagement assembly 312. The cable proceeds from pulley 310 to a pulley 314, also mounted on rider assembly 309, and then engages pulley 300.

The apparatus of FIG. 14 provides full coverage of a rectangular area, rather than coverage of a partially circular area, as provided by the apparatus of FIG. 1. The Cartesian position of the patient engagement assembly 312 is independent of its height and may be determined by merely sliding the rider assembly 309 along cross-beam support element 284 and rolling support element 284 along rails 280 and 282.

Figure 15:
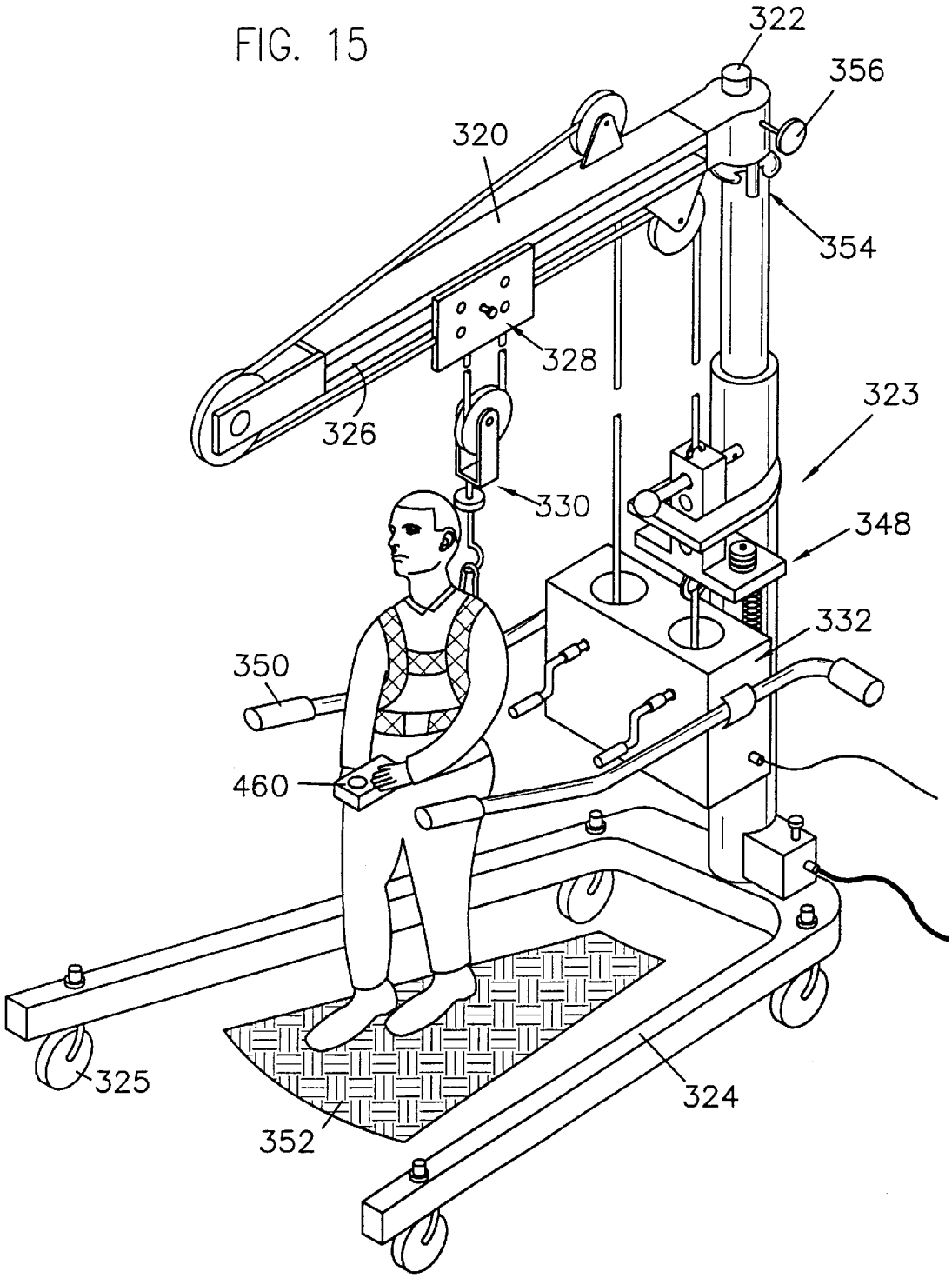

Reference is now made to FIG. 15, which illustrates a movable patient lifting and support system constructed and operative in accordance with a preferred embodiment of the present invention. The system comprises a support arm 320 which is pivotably supported for rotation in a horizontal plane about a generally vertical axis 322. Axis 322 is typically defined by a movable support assembly 323 which provides, in principle, the possibility of rotation through 360 degrees.

Movable support assembly 323 comprises a base 324 which is preferably movable on a support surface, such as a floor. In the illustrated embodiment, base 324 is supported on wheels 325.

Support arm 320 defines a generally horizontal track 326 along which a rider assembly 328 is slidably movable, so as thus to be radially positionable along the track 326 at an azimuth determined by the rotational orientation of arm 320 with respect to base 324.

A patient engagement assembly 330 is operatively associated with rider assembly 328 and with support arm 320 by means of a pulley and cable system which may be identical to that shown and described hereinabove, with particular reference to FIGS. 2A and 2B. It is a particular feature of the present invention that rider assembly 328 is relatively free to slide along track 326 independently of operation and operative orientation of the pulley and cable system.

The pulley and cable system comprises winch apparatus 332, which may be manually or electrically controlled, and may be identical to the winch apparatus 32 described hereinabove. The winch apparatus 332 is preferably mounted on base 324, as illustrated and is thus movable therewith. An adjustable shock absorbing, displacement limiting and loading assembly 348, which may be identical to assembly 48 described hereinabove, is also provided.

A handle assembly 350 is provided by use by a patient and/or an assisting person.

In the illustrated embodiment of FIG. 15, the apparatus provides freedom of movement of the patient within an area designated by reference numeral 352, without moving of the base 324. This area is defined by the limits of azimuthal rotation of support arm 320 with respect to base 324, which may be established by a limiter assembly 354. The support arm 320 may also be locked against rotation by means of a locking element 356. It is appreciated that by moving base 324, limitless freedom of movement may be achieved.

Reference is now made to FIGS. 16 and 17, which illustrate a movable patient lifting and support system constructed and operative in accordance with another preferred embodiment of the present invention. The system comprises a support arm 420 which is fixedly supported onto a movable support assembly 423.

Movable support assembly 423 comprises a base 424 which is readily movable on a support surface, such as a floor. In the illustrated embodiment, base 424 is supported on an air cushion which is preferably provided all along base 424 by an air cushion generating system including an apertured manifold 426 and a skirt 428 depending therefrom and engaging the support surface.

The manifold 426 and skirt 428 are shown clearly in FIG. 17, which also shows a typical support surface engagement brake 429, which is preferably provided on both sides of base 424, and which serves to provide a controllable amount of frictional resistance to movement of the base 424 along a floor surface.

Manifold 426 may receive compressed air or other gas from a remote source via a pressurized gas conduit 431, as shown. Alternatively, a compressor (not shown) may be mounted on base 424. Similarly, electrical power may be provided via an electrical cable 435 or alternatively by a battery (not shown) mounted on the base 424. It is appreciated that when the pressurized air or gas and electrical connections are eliminated, a truly independent support device is provided to the patient.

A patient engagement assembly 432 is operatively associated with support arm 420 by means of a pulley and cable system which may a simplified version of that shown and described hereinabove, with particular reference to FIGS. 2A and 2B, inasmuch as azimuthal and radial movement relative to base 424 is not provided in the illustrated embodiment.

The pulley and cable system comprises winch apparatus 433, which may be manually or electrically controlled, and may be identical to the winch apparatus 32 described hereinabove. The winch apparatus 433 is preferably mounted on base 424, as illustrated and is thus movable therewith. An adjustable shock absorbing, displacement limiting and loading assembly 448, which may be identical to assembly 48 described hereinabove, is also provided.

A handle assembly 450 is provided by use by a patient and/or an assisting person.

In the illustrated embodiment of FIG. 16, the apparatus permits only rotation, raising and lowering of the patient relative to the base 424. Inasmuch as movement of the base 424 is relatively effortless, the effective range of movement of the patient, achieved by moving the base 424 is nearly limitless.

In both the embodiments of FIGS. 15 and 16, control of the operation of the apparatus may be achieved by use of a patient hand-held wireless control device, indicated by reference numeral 460, or by any other suitable mechanism.

Figure 18:
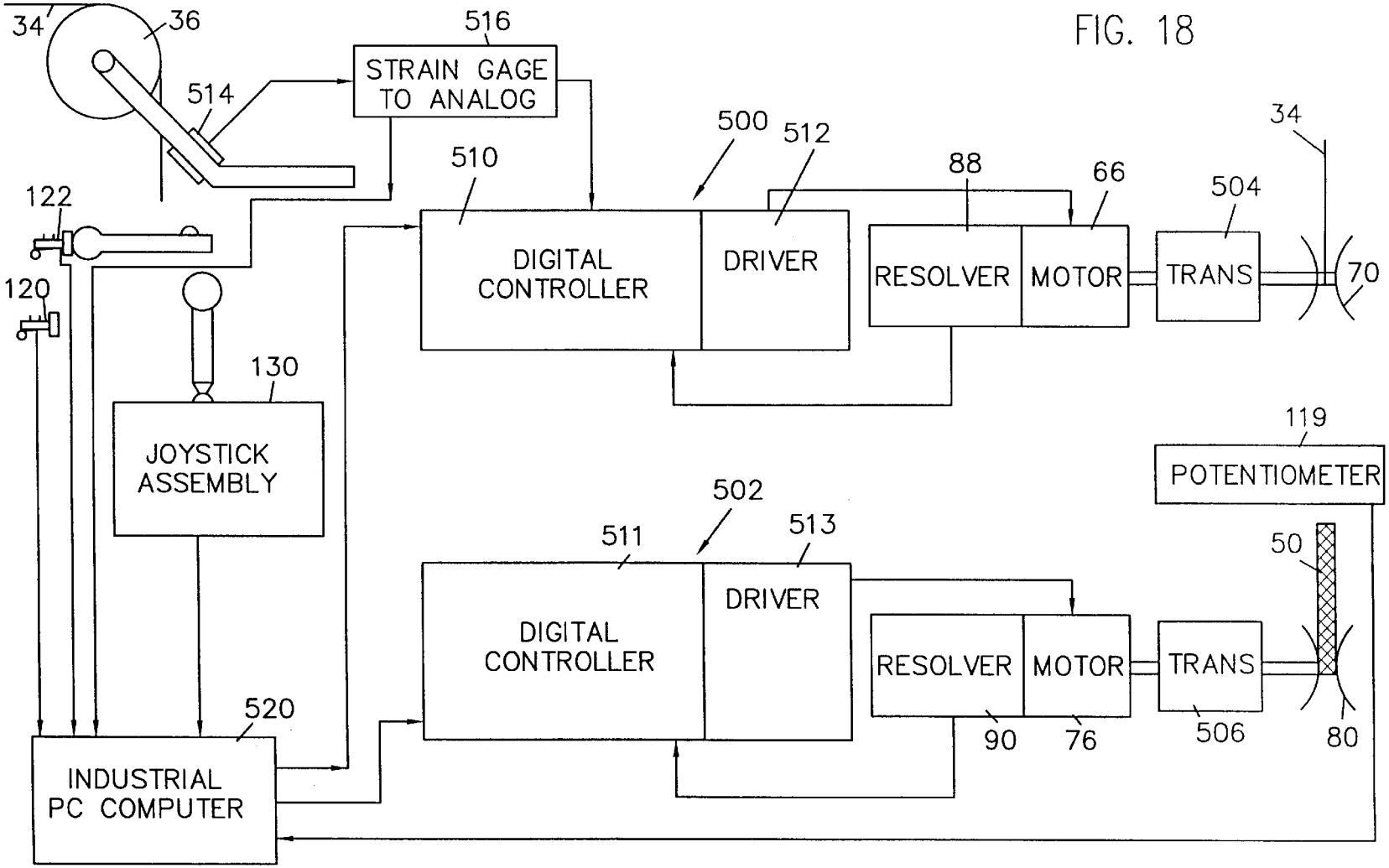
FIG. 18 is a generalized block diagram of control apparatus useful in the system of any of FIGS. 1–17.

Reference is now made to FIG. 18, which is a generalized block diagram of control apparatus useful in the systems of any of FIGS. 1–17. The control apparatus comprises first and second controller-drivers 500 and 502, which operate respective motors 66 and 76 (FIG. 1) with which are associated respective resolvers 88 and 90 (FIG. 1). Motors 66 and 76 respectively drive winding drums 70 and 80 (FIG. 3) via respective transmissions 504 and 506. Transmissions 504 and 506 each may be constructed generally as shown in FIG. 4.

Controller-drivers 500 and 502 preferably include respective digital controllers 510 and 511, and respective drivers 512 and 513, all of which are commercially available under catalog number DBSC1100 from Baldor Electric Company of Fort Smith, Ariz. U.S.A. and Servotech Control Technology Ltd. of Rishon Le Zion, Israel.

An industrial PC computer 520, such as an AX 6055A of Axiom Technology Co. Ltd. of Taiwan, R.O.C. having a PC/AT CACHE ALL-IN-ONE PLUG-IN CPU CARD AX8OU86/486, a SIMM TMS-1000-70 memory module and a multiplication I/O board for IBM PC AT A-M10-16D commercially available from National Instruments of Austin, Tex., U.S.A., is employed to carry out various control functions which are described hereinbelow.

A joystick assembly 130, such as that illustrated in FIG. 6, interfaces with computer 520. Computer 520 receives an analog input from linear potentiometer 119 (FIG. 3) and an input from a strain gage 514, mounted onto pulley 36 (FIG. 1), via a strain gage to analog converter 516. Strain gage 514 indicates the amount of tension present on cable 34 (FIG. 1). Computer 520 also receives inputs from microswitches 120 and 122 and provides analog outputs to digital controllers 510 and 511.

Digital controllers 510 and 511 receive inputs from respective resolvers 88 and 90, associated therewith.

Figure 19A:
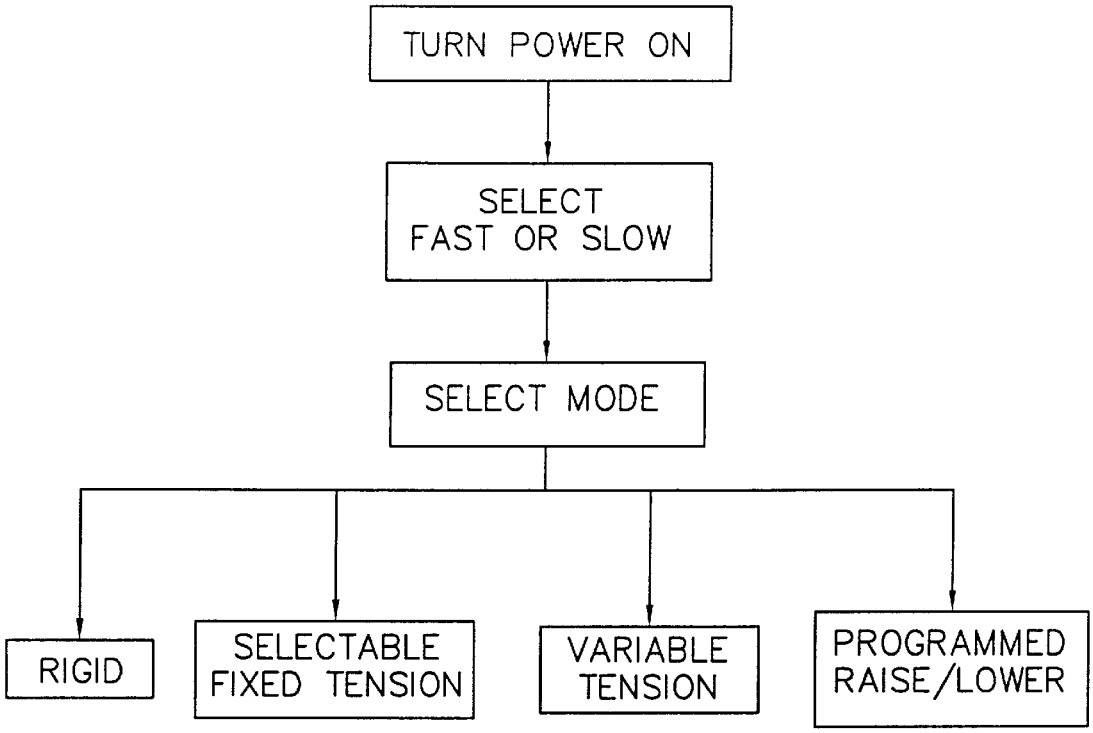
FIGS. 19A–19E together constitute a simplified flow chart illustrating various functionalities of the control apparatus of FIG. 18.

Reference is now made to FIGS. 19A–19E, which together constitute a simplified flow chart illustrating various functionalities of the control apparatus of FIG. 18, depending on the function selected by s851 witch 138 (FIG. 6). FIG. 19A illustrates four alternatively selectable modes of operation, hereinafter termed: RIGID, SELECTABLE FIXED TENSION, VARIABLE TENSION and PROGRAMMED RAISE/LOWER.

When the RIGID mode of operation is selected, the joystick position determines the vertical position of the patient engagement assembly 30 (FIG. 1).

When the joystick is in a RAISE orientation, the assembly 30 is raised and conversely, when the joystick is in a LOWER orientation, the assembly 30 is lowered. When the joystick is in a NEUTRAL orientation, the vertical position of assembly 30 is maintained, notwithstanding variations in the vertical tension applied thereto.

When the SELECTABLE FIXED TENSION mode of operation is selected, the joystick position determines the vertical tension applied to the patient engagement assembly 30 (FIG. 1) in a linear manner.

When the joystick is in a RAISE orientation, the vertical tension applied to assembly 30 is increased and conversely, when the joystick is in a LOWER orientation, the vertical tension applied to assembly 30 is decreased. When the joystick is in a NEUTRAL orientation, the vertical tension applied to assembly 30 is maintained, notwithstanding variations in the vertical tension applied thereto.

When the VARIABLE TENSION mode of operation is selected, the joystick position determines the direction of vertical displacement of the patient engagement assembly 30 (FIG. 1).

When the joystick is in a RAISE orientation, the assembly 30 is raised and conversely, when the joystick is in a LOWER orientation, the assembly 30 is lowered. When the joystick is in a NEUTRAL orientation, drums 70 and 80 are prevented from rotation.

When the PROGRAMMED RAISE/LOWER mode of operation is selected, and the joystick is in a NEUTRAL orientation, the assembly 30 is periodically raised and lowered in a selectably preprogrammed manner, as for providing exercise to particular parts of a patient's body.

During operation in all of the above modes of operation, a safety limiting function immediately terminates lowering of assembly 30, and thus of the patient, upon occurrence of a predetermined drop in assembly 30 within a predetermined time. The predetermined drop is typically 10 cm and the predetermined time is typically 5 seconds. The intention is to prevent the patient from failing, but nevertheless to permit slow vertical movements, such as descending stairs. The safety limiting function may be overridden by the operation of switch 142 (FIG. 6) by an authorized attendant. The safety limiting function is carried out by computer 520 by repeatedly and sequentially examining whether patient engagement assembly 30, and thus the patient supported thereby, has fallen more than a predetermined vertical distance during a predetermined time.

The predetermined time may be set and the calculations and thresholding carried out by computer 520. When a drop greater than the predetermined drop is sensed within the predetermined time, the computer 520 provides a system stop signal (HOLD) to controller 510, which immediately freezes the position of assembly 30. Intervention of authorized personnel, preferably key controlled, is required to unfreeze assembly 30.

At all times, the control system operates in the safety limiting function environment, unless overridden by a key operated mechanism accessible only to authorized care personnel.

Figure 20:
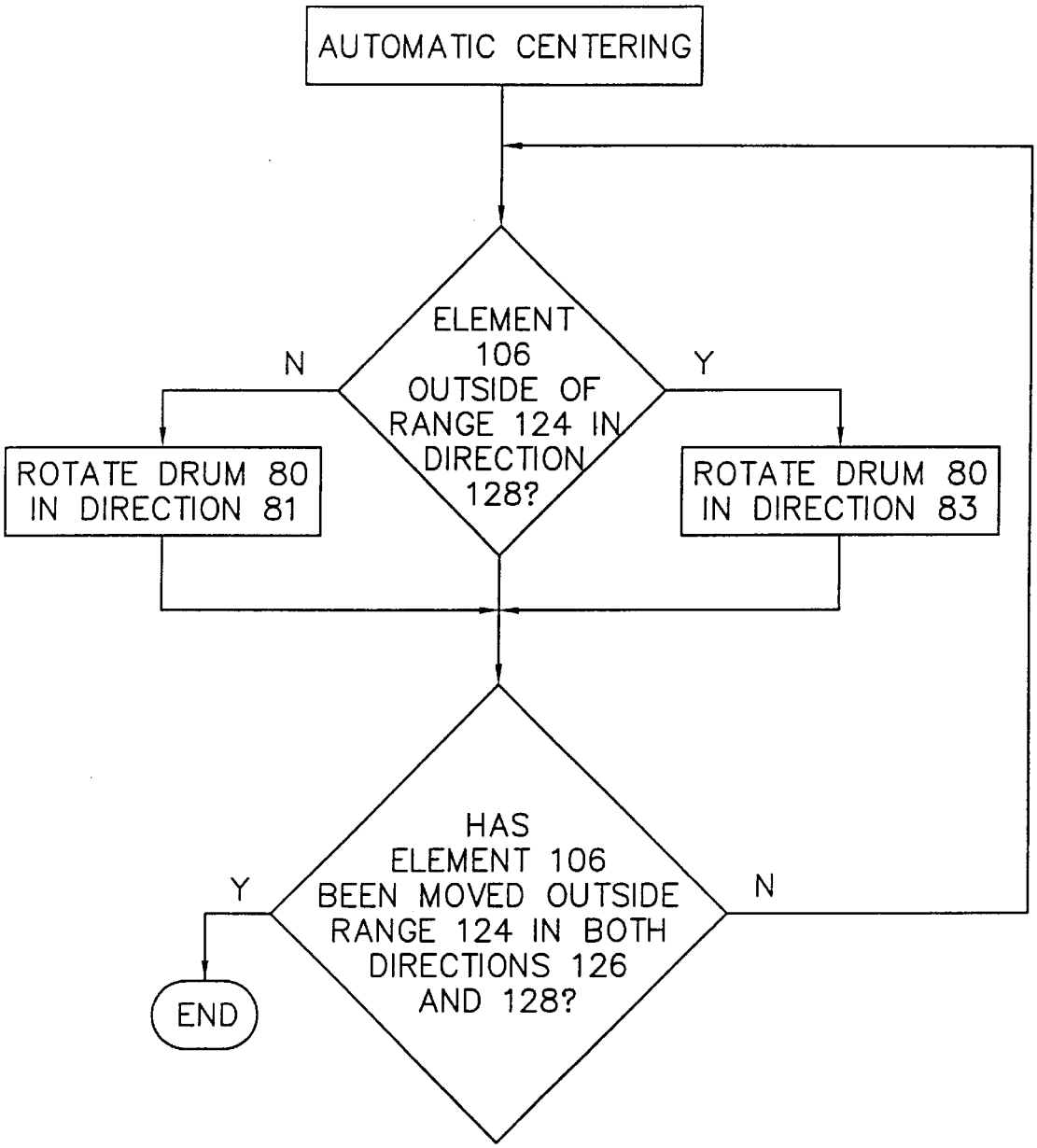
FIG. 20 is a simplified flow chart illustrating an automatic centering function employed in accordance with a preferred embodiment of the present invention.

Upon entering any of the four alternatively selectable modes of operation, an automatic centering operation is carried out in order to position element 106 generally at the center of range 124. The automatic centering operation is illustrated in flow chart form in FIG. 20 and will now be described.

In the automatic centering operation, potentiometer 119 senses whether element 106 has been displaced outside of range 124. If potentiometer 119 senses that element 106 is displaced outside of range 124 in a direction indicated by arrow 126, drum 80 is rotated in a direction 81, to increase the tension on secondary cable 50 so as to lower element 106 back within range 124.

If potentiometer 119 senses that element 106 is displaced outside of range 124 in a direction indicated by arrow 128, drum 80 is rotated in a direction 83, opposite to direction 81, to decrease the tension on secondary cable 50 so as to raise element 106 back within range 124.

The above-described activity continues until after element 106 has been positioned outside range 124 in both directions 126 and 128 and is present or nearly present within range 124.

Figure 19B:
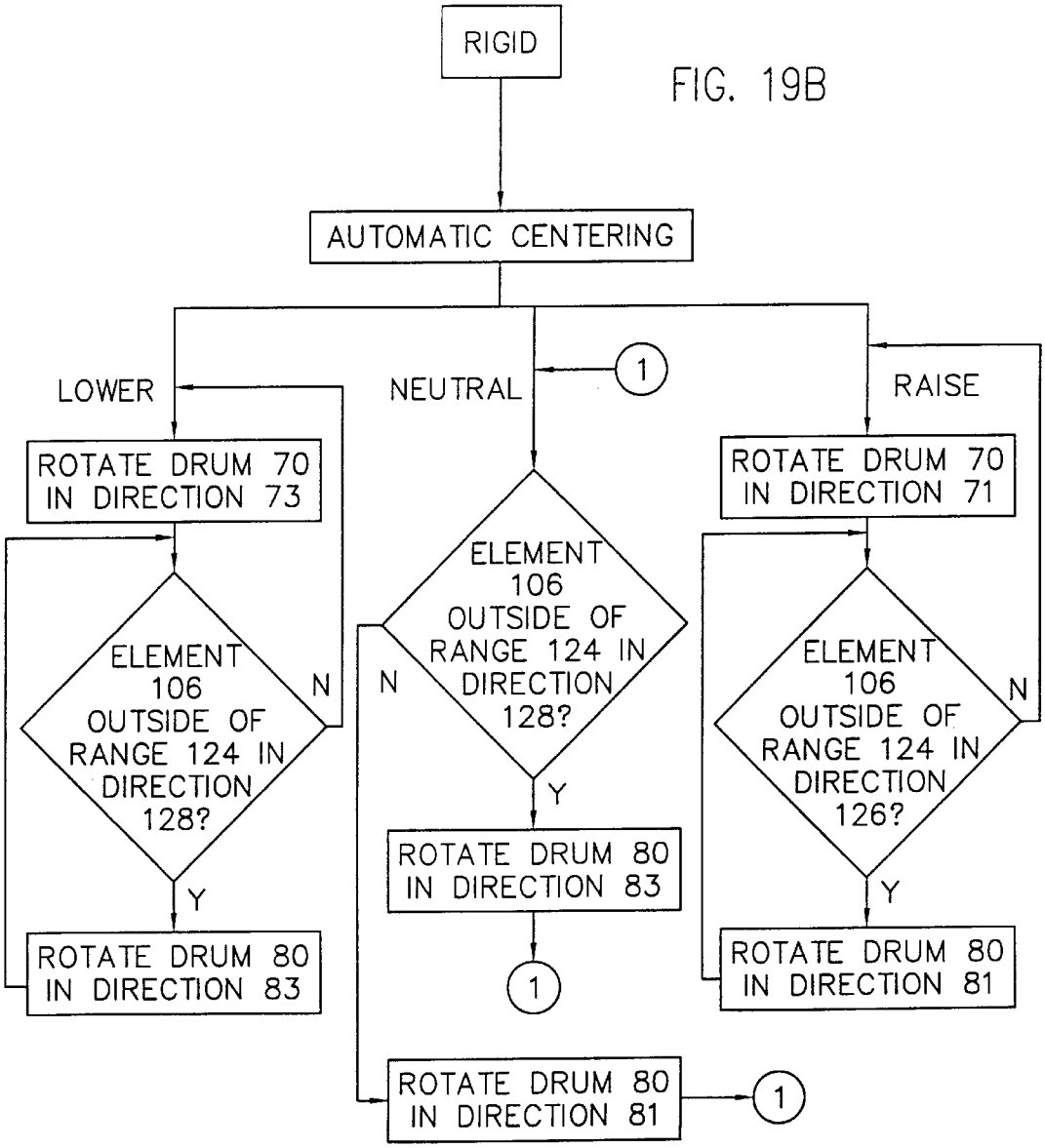
Figure 19C:
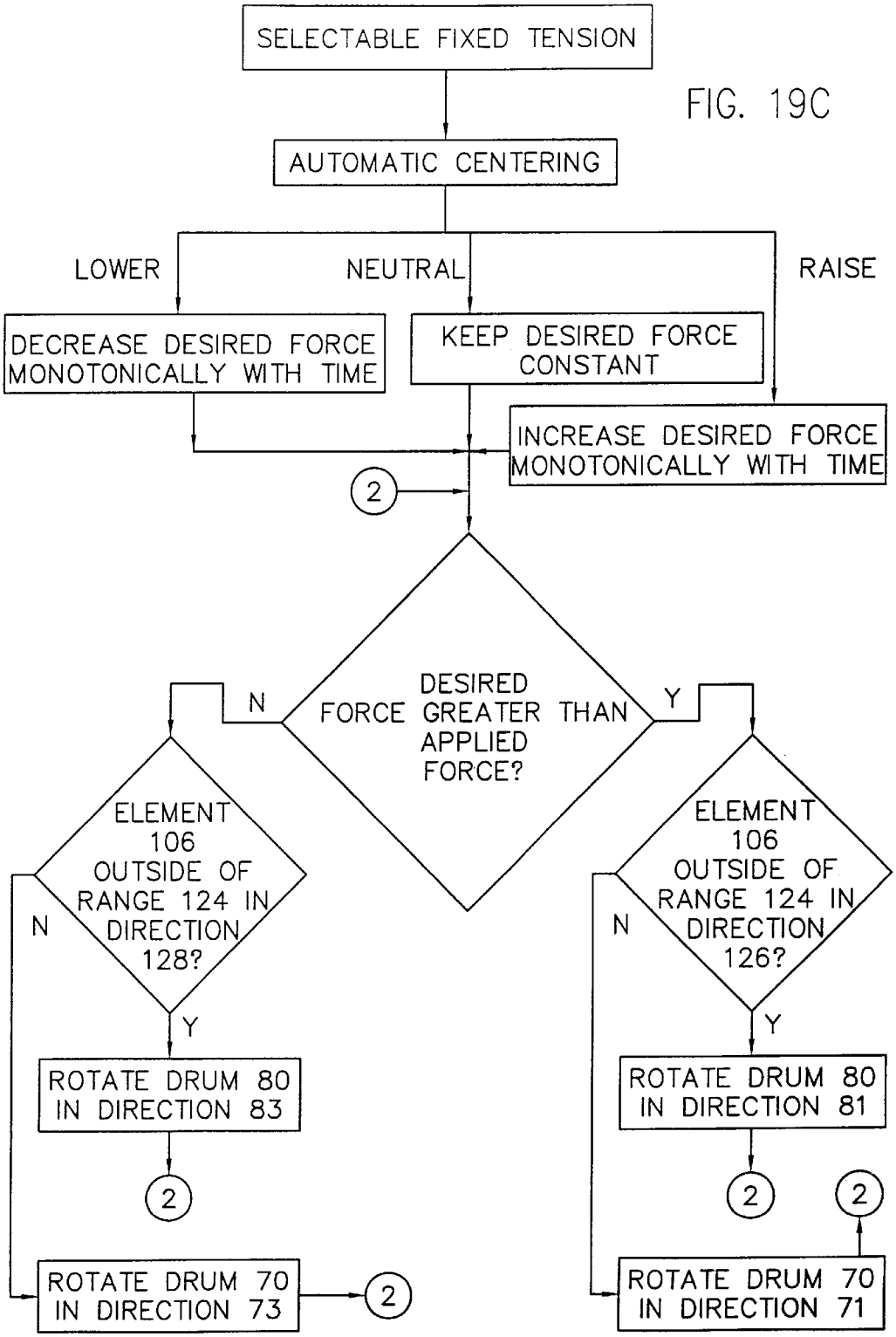

For clarification of the "question boxes" in FIG. 19B and 19C, with reference to FIG. 3, it is necessary to define two working areas of element 106, in the modes of RAISE, LOWER and NEUTRAL.

In the RAISE mode, the logic circuit will answer "NO" for all positions of element 106 in the range 124 and including all positions outside range 124 in the direction 128. The logic circuit will answer "YES" for all positions of the element 106 outside range 124 in the direction 126.

For the LOWER and NEUTRAL modes, the logic circuit will answer "NO" for all positions of element 106 in the range 124 and including all positions outside of range 124 in the direction 126. The logic circuit will answer "YES" for all positions of the element 106 outside range 124 in the direction 128.

Figure 2B:
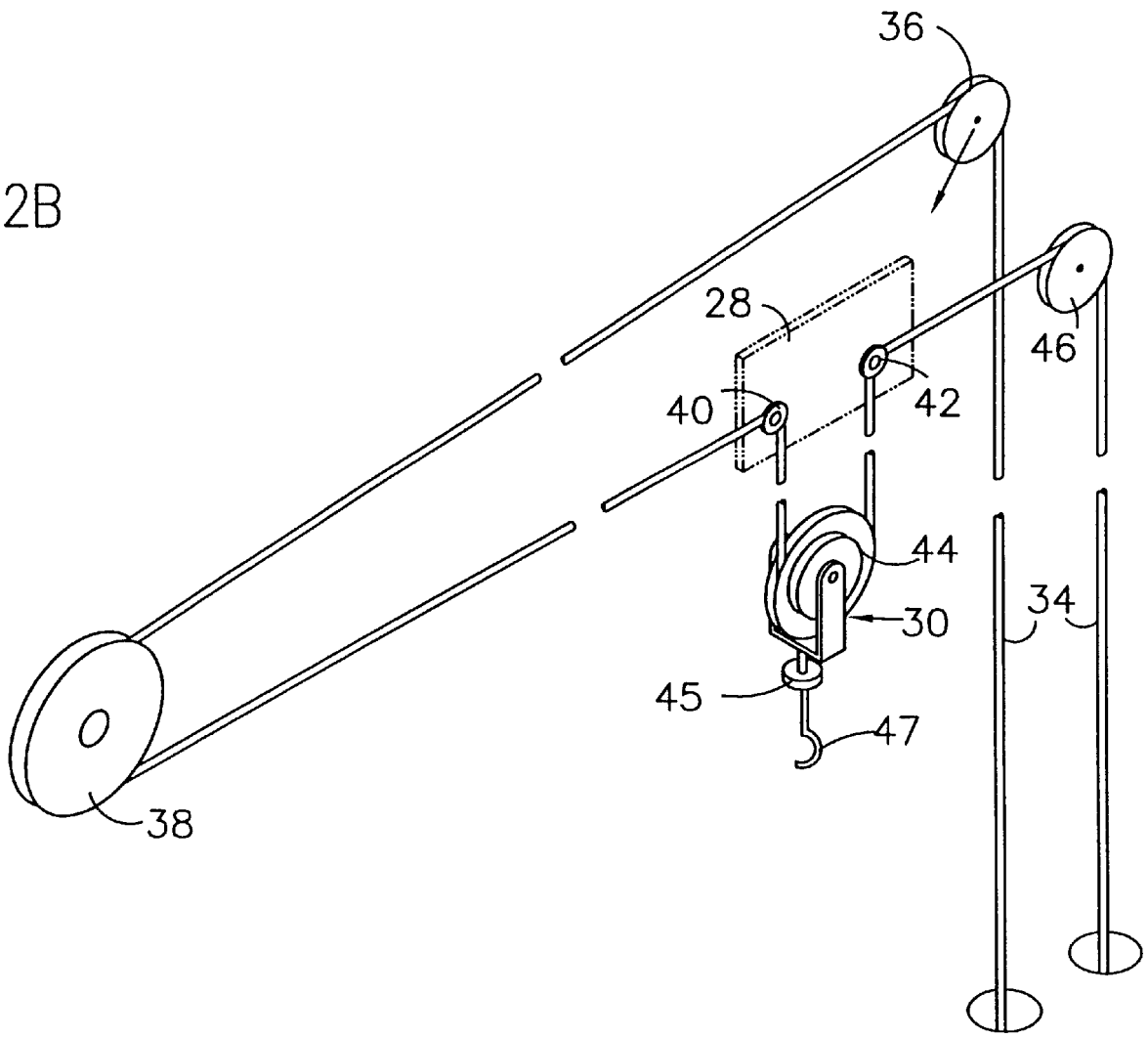
FIG. 2B is a simplified pictorial illustration illustrating part of the apparatus of FIG. 1.

The operation of the control apparatus of FIG. 18 in the RIGID mode is now described with particular reference to FIG. 19B as well as FIGS. 2B and 3. The position of joystick 136 is assumed to fall within one of three categories, RAISE, LOWER and NEUTRAL. Referring to FIG. 19B, following the centering operation, if the joystick 136 is in the RAISE position during RIGID mode, drum 70 is rotated In direction 71, thereby winding cable 34 thereon. Potentiometer 119 senses whether element 106 has been displaced outside of range 124. If not, rotation of drum 70 in direction 71 continues. If potentiometer 119 senses that element 106 is displaced outside of range 124 in a direction indicated by arrow 126, drum 80 is rotated in a direction 81 to tension secondary cable 50 so as to lower element 106 back within range 124. The above-described activity continues so long as joystick 136 remains in the RAISE position.

When the joystick 136 is in the RAISE position during RIGID mode and the force exerted by the patient on patient engagement assembly 30 remains constant, the rotation of drum 70 in direction 71 proceeds monotonically. The force exerted by the patient may remain constant when, for example, as the patient is raised he lifts himself increasingly with his legs and/or arms or moves along an upwardly extending support surface, so as to compensate for the increased lifting force applied to him as he is raised. Operation in the RAISE position continues until the tension on cable 34 is so great that centering cannot be achieved. At this stage element 106 engages microswitch 120 which terminates the RAISE function.

If the joystick 136 is in the LOWER position, drum 70 is rotated in a direction 73 opposite to direction 71, thereby unwinding cable 34 therefrom. Potentiometer 119 senses whether element 106 has been displaced outside of range 124. If not, rotation of drum 70 in direction 73 continues. If potentiometer 119 senses that element 106 is displaced outside of range 124 in a direction indicated by arrow 128, drum 80 is rotated in a direction 83, opposite to direction 81, to decrease the tension on secondary cable 50 so as to raise element 106 back within range 124. The above-described activity continues so long as joystick 136 remains in the LOWER position.

When the joystick 136 is in the LOWER position during RIGID mode and the downward force exerted by the patient on patient engagement assembly 30 remains constant the rotation of drum 70 in direction 73 proceeds monotonically.

When the joystick 136 is in the LOWER position during RIGID mode and the weight or downward force exerted by the patient on patient engagement assembly 30 increases, such as because the patient begins to place more of his weight on assembly 30, the rotation of drum 70 in direction 73 proceeds monotonically.

When the joystick 136 is in the LOWER position during RIGID mode and the downward force exerted by the patient on patient engagement assembly 30 decreases, for example because the patient begins to place less of his weight on assembly 30 or moves upwardly along an inclined support surface or stairs, the rotation of drum 70 in direction 73 proceeds monotonically and intermittently drum 80 rotates in direction 83 to accommodate the increase in weight.

If the joystick 136 is in the NEUTRAL position, potentiometer 119 senses whether element 106 has been displaced outside of range 124.

If potentiometer 119 senses that element 106 is displaced outside of range 124 in a direction indicated by arrow 126, drum 80 is rotated in a direction 81, to increase the tension on secondary cable 50 so as to lower element 106 back within range 124.

If potentiometer 119 senses that element 106 is displaced outside of range 124 in a direction indicated by arrow 128, drum 80 is rotated in a direction 83, opposite to direction 81, to decrease the tension on secondary cable 50 so as to raise element 106 back within range 124.

The above-described activity continues so long as joystick 136 remains in the NEUTRAL position and is independent of whether the weight of the patient or the downward force exerted by the patient on assembly 30 increases, decreases or remains constant.

The operation of the control apparatus of FIG. 18 in the SELECTABLE FIXED TENSION mode is now described with particular reference to FIG. 19C. The position of joystick 136 is assumed to fall within one of three categories, RAISE, LOWER and NEUTRAL.

At all times, the control system, operates in a safety limiting function environment, unless overridden by a key operated mechanism accessible only to authorized care personnel. The operation of the safety limiting function is described above.

Upon entering the SELECTABLE FIXED TENSION mode, an automatic centering operation is carried out in order to position element 106 generally at the center of range 124. The automatic centering operation is described above and illustrated in flow chart form in FIG. 20.

Following the centering operation, if the joystick assembly 136 is in the RAISE position in the SELECTABLE FIXED TENSION mode, the desired force increases monotonically with time.

If the joystick assembly 136 is in the LOWER position in the SELECTABLE FIXED TENSION mode, the desired force decreases monotonically with time If the joystick assembly 136 is in the NEUTRAL position in the SELECTABLE FIXED TENSION mode, the desired force is kept constant.

In all three positions of operation, sensor 514 senses the tension on cable 34. If the tension on cable 34 is less than the tension desired by the operator, potentiometer 119 senses whether element 106 has been displaced outside of range 124 in a direction indicated by arrow 126. If not, drum 70 is rotated in direction 71. If potentiometer 119 senses that element 106 is displaced outside of range 124 in a direction indicated by arrow 126, drum 80 is rotated in a direction 81 to tense secondary cable 50 so as to lower element 106 back within range 124. The above-described activity continues so long as the tension on cable 34 sensed by sensor 514 is less than the tension desired by the operator.

In all three positions of operation, if the tension on cable 34 as sensed by sensor 514 is greater than or equal to the tension desired by the operator, potentiometer 119 senses whether element 106 has been displaced outside of range 124 in a direction indicated by arrow 128. It not, drum 70 is rotated in direction 73. If potentiometer 119 senses that element 106 is displaced outside of range 124 in a direction indicated by arrow 126, drum 80 is rotated in a direction 82 to decrease tension on secondary cable 50 so as to raise element 106 back within range 124. The above-described activity continues so long as the tension on cable 34 sensed by sensor 514 is greater than or equal to the tension desired by the operator.

Figure 19D:
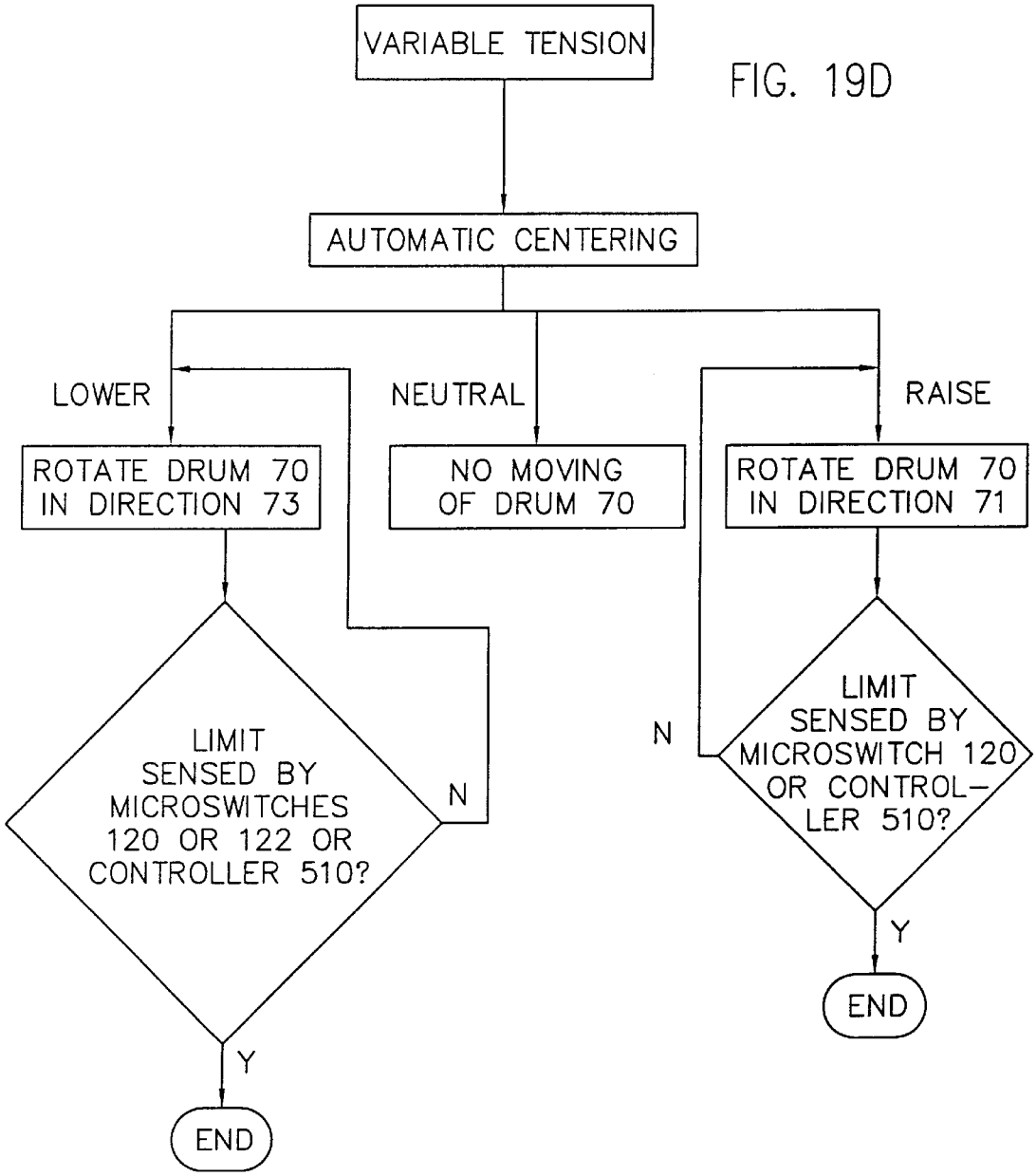
Figure 19E:
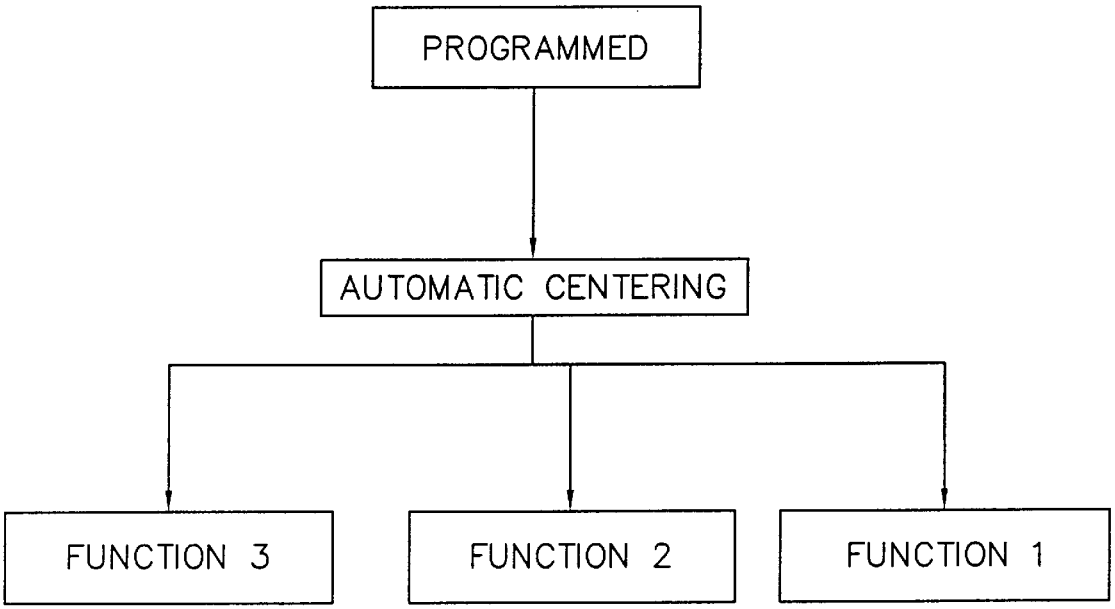

The operation of the control apparatus of FIG. 18 in the VARIABLE TENSION mode is now described with particular reference to FIG. 19D. The position of joystick 136 is assumed to fall within one of three categories, RAISE, LOWER and NEUTRAL.

At all times, the control system operates in a safety limiting function environment, unless overridden by a key operated mechanism accessible only to authorized care personnel. The operation of the safety limiting function is described above.

Upon entering the VARIABLE TENSION mode, an automatic centering operation is carried out in order to position element 106 generally at the center of range 124. The automatic centering operation is described above and illustrated in flow chart form in FIG. 20.

Following the centering operation, if the joystick 136 is in the RAISE position, drum 70 is rotated in direction 71, thereby winding cable 34 thereon. The winding continues until element 106 moves sufficiently upward with respect to portion 102 so that it is stopped by shock absorber 114 and/or by guide and spacer element 112 and/or microswitch 120. Rotation of drum 70 continues until the tension in cable 34, as sensed by strain gage 514 and transmitted via strain gage to analog converter 516 to digital controller 510, exceeds a threshold established in digital controller 510, which terminates rotation of drum 70 in direction 71.

When the joystick 136 is in the RAISE position during VARIABLE TENSION mode and the force exerted by the patient on patient engagement assembly 30 remains constant, the rotation of drum 70 in direction 71 proceeds monotonically.

When the joystick 136 is in the RAISE position during VARIABLE TENSION mode and the downward force exerted by the patient on patient engagement assembly 30 increases, the rotation of drum 70 in direction 71 proceeds monotonically until element 106 moves sufficiently upward with respect to portion 102 so that it is stopped by shock absorber 114 and/or by guide and spacer element 112 and/or microswitch 120.

When the joystick 136 is in the RAISE position during VARIABLE TENSION mode and the downward force exerted by the patient on patient engagement assembly 30 decreases, the rotation of drum 70 in direction 71 proceeds monotonically. As the downward force continues to decrease, element 106 moves downward with respect to portion 102 until its downward movement is stopped by pin 110 and/or microswitch 122, thereby terminating rotation of drum 70. Rotation of drum 70 in direction 71 will occur again only upon increased downward force exerted by the patient on patient engagement assembly 30 which causes element 106 to move upwardly away from pin 110 and/or microswitch 122.

If the joystick 136 is in the LOWER position, drum 70 is rotated in a direction 73 opposite to direction 71, thereby unwinding cable 34 therefrom. The above-described activity continues so long as joystick 136 remains in the LOWER position.

When the joystick 136 is in the LOWER position during VARIABLE TENSION mode and the downward force exerted by the patient on patient engagement assembly 30 remains constant the rotation of drum 70 in direction 73 proceeds monotonically until no more cable 34 is available.

When the joystick 136 is in the LOWER position during VARIABLE TENSION mode and the downward force exerted by the patient on patient engagement assembly 30 increases, element 106 moves sufficiently upward with respect to portion 102 so that it is stopped by shock absorber 114 and/or by guide and spacer element 112 and/or microswitch 120. Eventually the downward force exerted by the patient on the patient engagement assembly 30 decreases or becomes constant.

When the joystick 136 is in the LOWER position during VARIABLE TENSION mode and the downward force exerted by the patient on patient engagement assembly 30 decreases, the rotation of drum 70 in direction 73 proceeds monotonically. As the downward force continues to decrease, element 106 moves downward with respect to portion 102 until its downward movement is stopped by pin 110 and/or microswitch 122.

If the joystick 136 is in the NEUTRAL position and the downward force exerted by the patient on patient engagement assembly 30 increases, element 106 moves upward with respect to portion 102 until it is stopped by shock absorber 114 and/or by guide and spacer element 112. If the downward force exerted by the patient on patient engagement assembly 30 decreases, element 106 moves downward with respect to portion 102 until its downward movement is stopped by pin 110.

Thus, the different modes of operation of the patient engagement assembly, described hereinabove, may be briefly summarized as follows:

The RIGID mode is characterized in that the vertical position of assembly 30 is maintained, notwithstanding variations in the vertical tension applied. The SELECTABLE FIXED TENSION mode is characterized in that a desired vertical tension is applied to assembly 30. The VARIABLE TENSION mode is characterized in that the vertical tension on the assembly 30 varies as a function of the vertical position and is dependent on the combination of forces, which are derived from the belt 50 and its tension therein, spring 116, counter-weights 118 and the range of operation of shock absorber 114. The functions of the PROGRAMMED RAISE/LOWER mode are as follows:

FUNCTION 1—a sinusoidal raising and lowering motion with predetermined frequency and amplitude as in the RIGID mode.

FUNCTION 2—a sinusoidal raising and lowering motion similar to FUNCTION 1 but also incorporating a rest of predetermined duration at both the raised and lowered positions, as in the RIGID mode.

FUNCTION 3—a force increasing and decreasing operation with predetermined frequency and amplitude as in the SELECTABLE FIXED mode.

The joystick 136 may be used to operate the selected functions. For example, positioning of the joystick 136 in the RAISE position causes operation in the selected function. Positioning the joystick in either the NEUTRAL or LOWER positions does not produce any operation.

At all times, the control system operates in a safety limiting function environment, unless overridden by a key operated mechanism accessible only to authorized care personnel. The operation of the safety limiting function is described above. Upon entering the PROGRAMMED RAISE/LOWER mode, an automatic centering operation is carried out in order to position element 106 generally at the center of range 124. The automatic centering operation is described above and illustrated in low chart form in FIG. 20.

Figure 21:
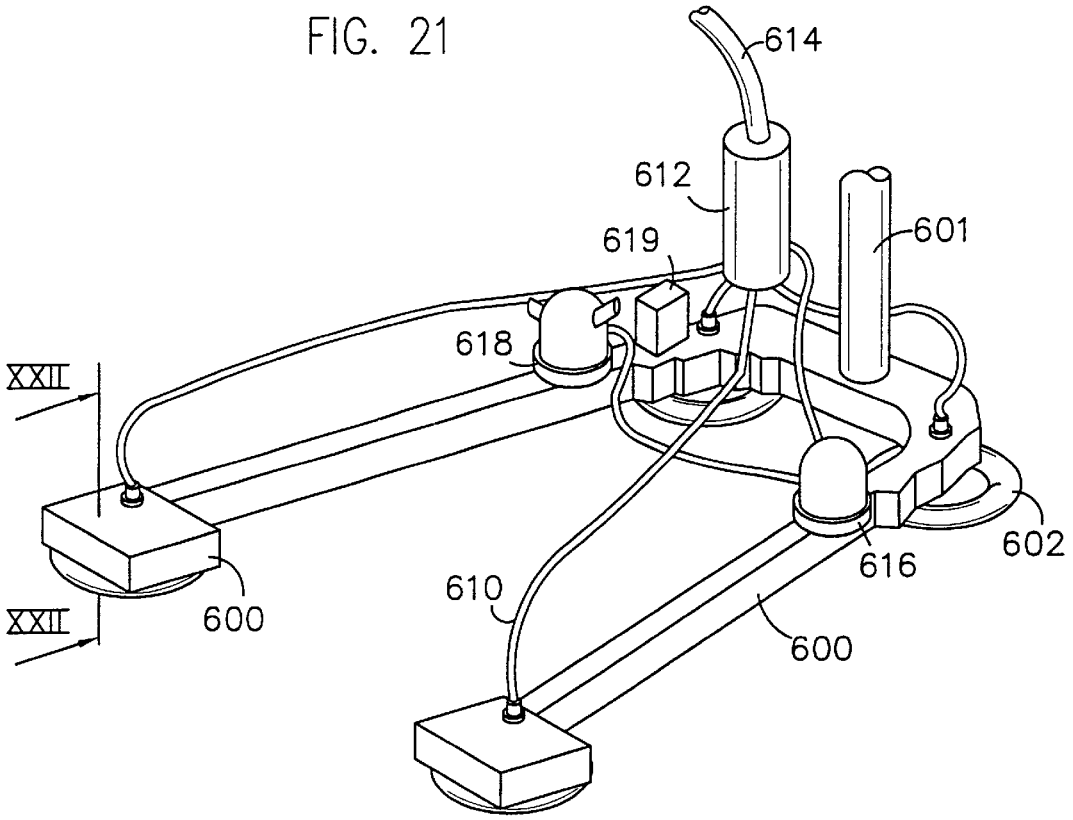
FIG. 21 is a more detailed illustration of an air cushion mechanism employed in accordance with an embodiment of the present invention.
Figure 22:
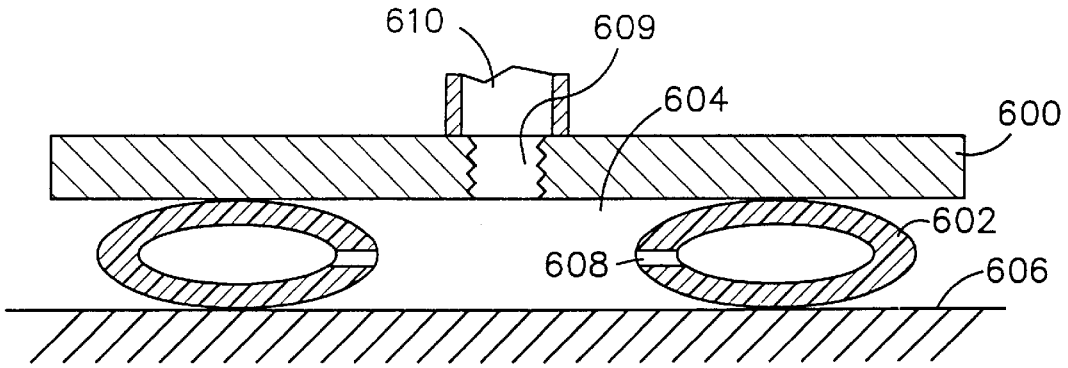
FIGS. 22 and 23 illustrate part of the apparatus of FIG. 21 in respective non-inflated and inflated operative conditions.
Figure 23:
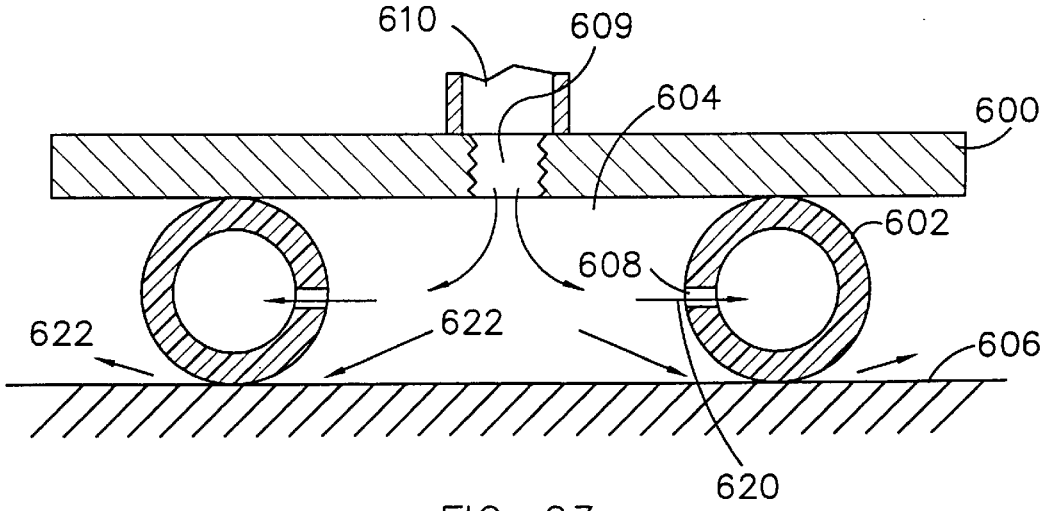

Following the centering operation, the above three functions or any other suitable functions may be selected and operated by placing joystick 136 in the RAISE position. Reference is now made to FIGS. 21–23, which illustrate an air cushion mechanism employed in accordance with an embodiment of the present invention, as in the embodiment of FIGS. 16 and 17. A base member 600 supporting a lifting assembly, part of which is shown at reference numeral 601.

Mounted on the underside of base member 600 are a plurality of inflatable enclosure members 602, each of which encloses a volume 604 located between the underside of base member 600 and a support surface 606. Preferably, the enclosure members 602 are somewhat resilient and may be formed of flexible plastic or rubber. In accordance with a preferred embodiment of the invention, each enclosure member 602 is provided with a pressurized aperture 608, which may communicate via an aperture 609 in base member 600 with a pressurized air supply conduit 610.

Pressurized air conduits 610 communicating with the enclosure members 602 are supplied with pressurized air via a manifold 612 with which may be associated pressure or flow limiting devices (not shown). Manifold 612 receives pressurized air via a conduit 614 from a pressurized air source. The pressurized air source, may include an air reservoir 616 and/or an air compressor 618 which is mounted on base member 600 and supplied with electrical power by a battery 619 or alternatively from mains power.

Alternatively or additionally, the conduit 614 may be a flexible conduit and receive pressurized air from an external fixed pressurized air source (not shown). When an air compressor is employed, it may be operated by batteries which may be supported on base member 600 and additionally or alternatively by mains power.

Referring now to FIGS. 22 and 23, it is seen that in the absence of the supply of pressurized air to the volume 604, as seen in FIG. 22, enclosure member 602 is partially compressed and provides a relatively large surface area in contact with the support surface 606. No air cushion is provided, and thus, the base member 600 does not tend to slide along the support surface 606.

Figure 24:
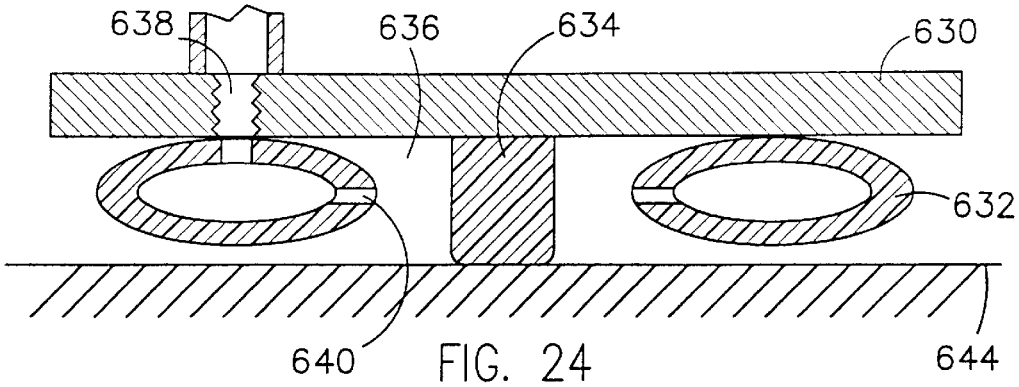
FIGS. 24, 25 and 26 illustrate an alternative embodiment of the apparatus of FIGS. 21–23 in respective uninflated, partially inflated and fully inflated operative conditions.
Figure 25:
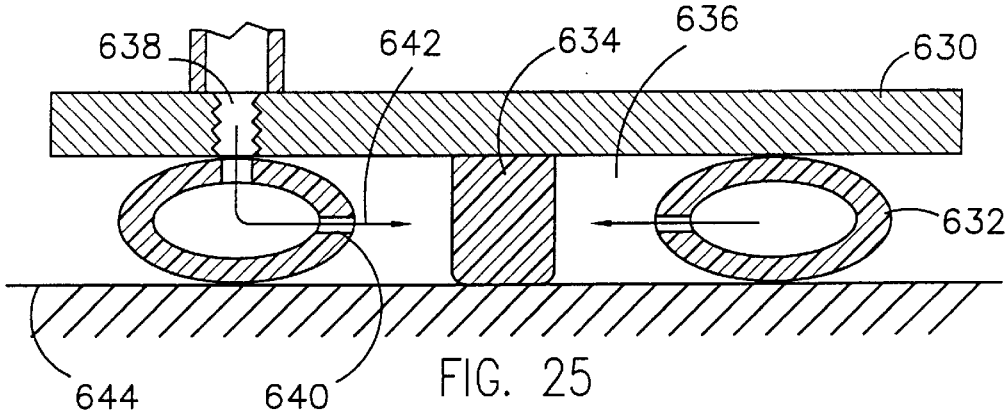
Figure 26:
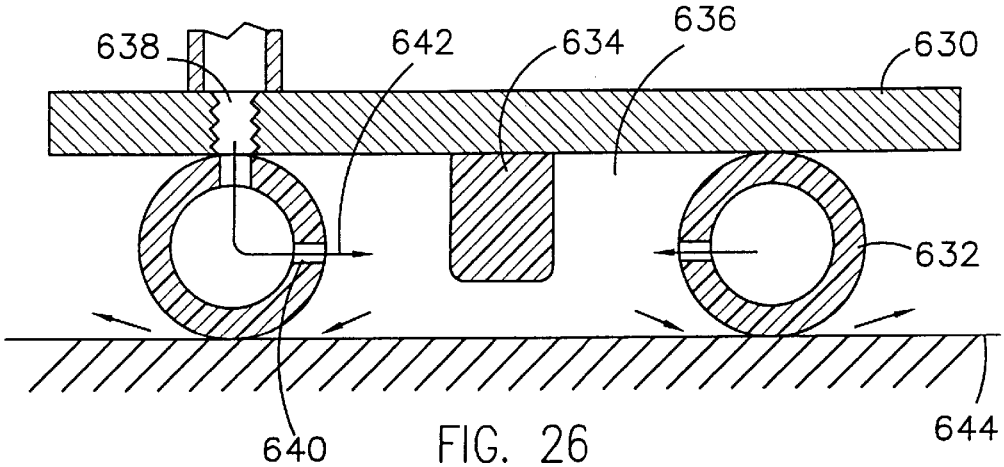

When pressurized air is supplied to volume 604, the pressurized air flows, as indicated by arrows 620, into enclosure member 602 via one or more apertures 608, thus inflating the enclosure member 602. This reduces the surface area of enclosure member 602 which is in contact with the support surface 606 and provides a flow of air, indicated generally by arrows 622, which passes between the underside of enclosure member 602 and the support surface 606, thereby providing an air cushion and permitting the base member 600 to slide relative to the support surface 606. Reference is now made to FIGS. 24, 25 and 26, which illustrate an alternative embodiment of the apparatus of FIGS. 21–23 in respective uninflated, partially inflated and fully inflated operative conditions. The illustrated embodiment of FIGS. 24, 25 and 26 employs in addition to a base member 630 and an inflatable enclosure 632 a relatively high friction support element 634, preferably disposed centrally of a volume 636 enclosed by enclosure 632.

The illustrated embodiment also shows inflation of volume 636 by means of a pressurized air input via an aperture 638 in base member 630 to enclosure member 632 and thence, via apertures 640 to volume 636. FIG. 24 shows the assembly in an uninflated condition, non-slidably resting on member 634. FIG. 25 illustrates the assembly in a partially inflated condition where arrows 642 indicate the direction of pressurized air flow which causes the enclosure member 632 to inflate and come into contact with a support surface 644. FIG. 26 illustrates the inflated, slidable condition of the assembly. It is appreciated that the effective cross-sectional area of apertures 640, the quantity of pressurized air supplied and its pressure determine the amount by which the enclosure member 632 inflates. Apertures 640 can be formed with a pressure responsive variable opening, such that upon increase of pressure within enclosure member 632, the effective cross-sectional area of apertures 640 increases accordingly.

Reference is now made to FIGS. 27–30 which illustrate the use of another preferred embodiment of air cushion mechanism constructed and operative in accordance with a preferred embodiment of the present invention.

Figure 27:
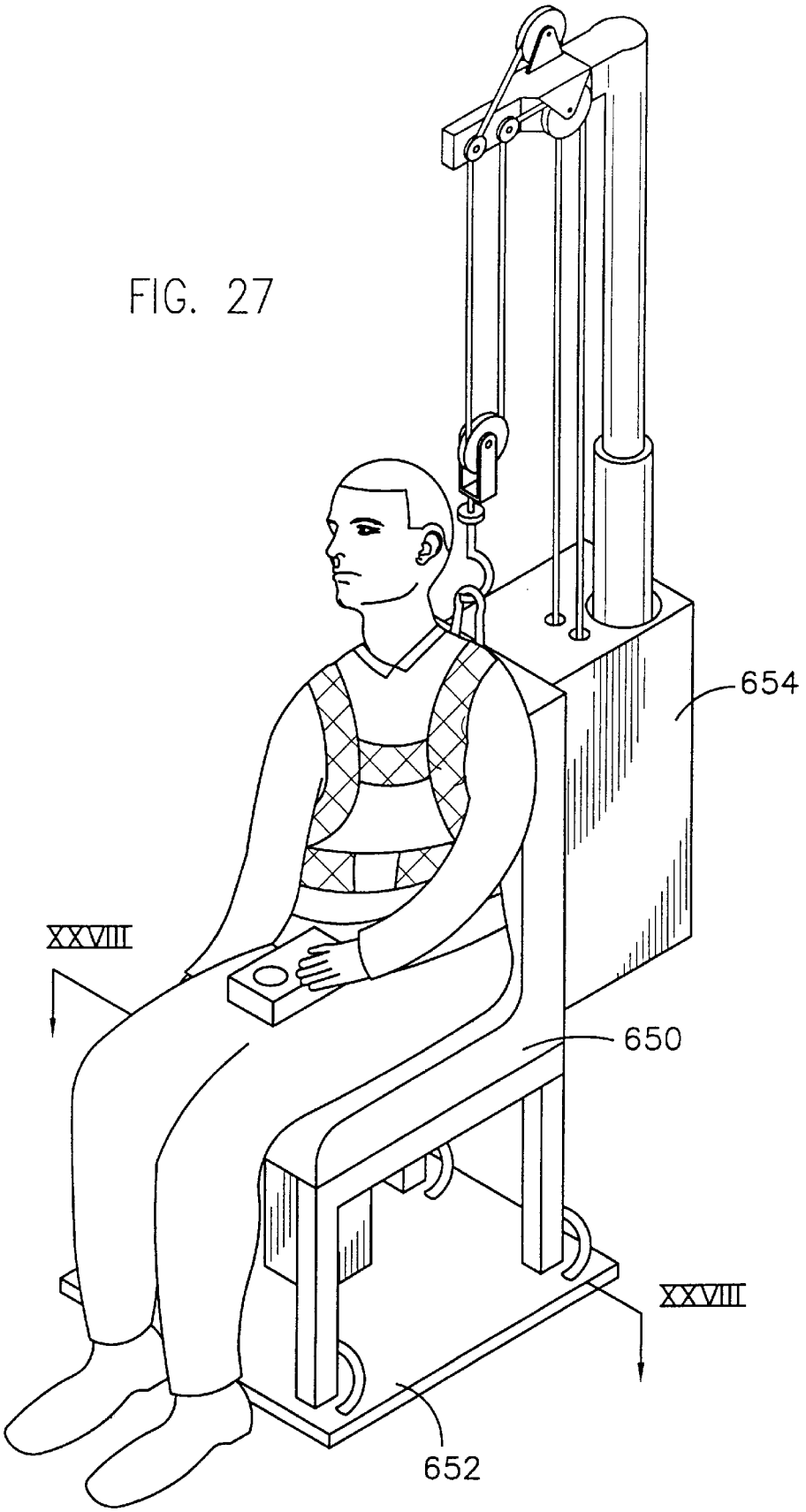
FIG. 27 is an illustration of a lifter-equipped chair employing air cushion mechanisms of the general type illustrated in FIGS. 21–26.

FIG. 27 is an illustration of a lifter-equipped chair 650 employing air cushion mechanisms of the general type illustrated in FIGS. 21–26. The chair 650 is supported on a platform 652 and may be entirely conventional. Mounted on the chair 650, or alternatively directly on the platform 652 is a lifting mechanism 654, which may be employed for raising a patient from a sitting position on the chair 650 to a standing position and/or for gently lowering the patient from a standing position to a sitting position on the chair 650. The lifting mechanism 654 may be essentially similar to that described hereinabove in connection with either of FIGS. 15 and 16.

Figure 28:
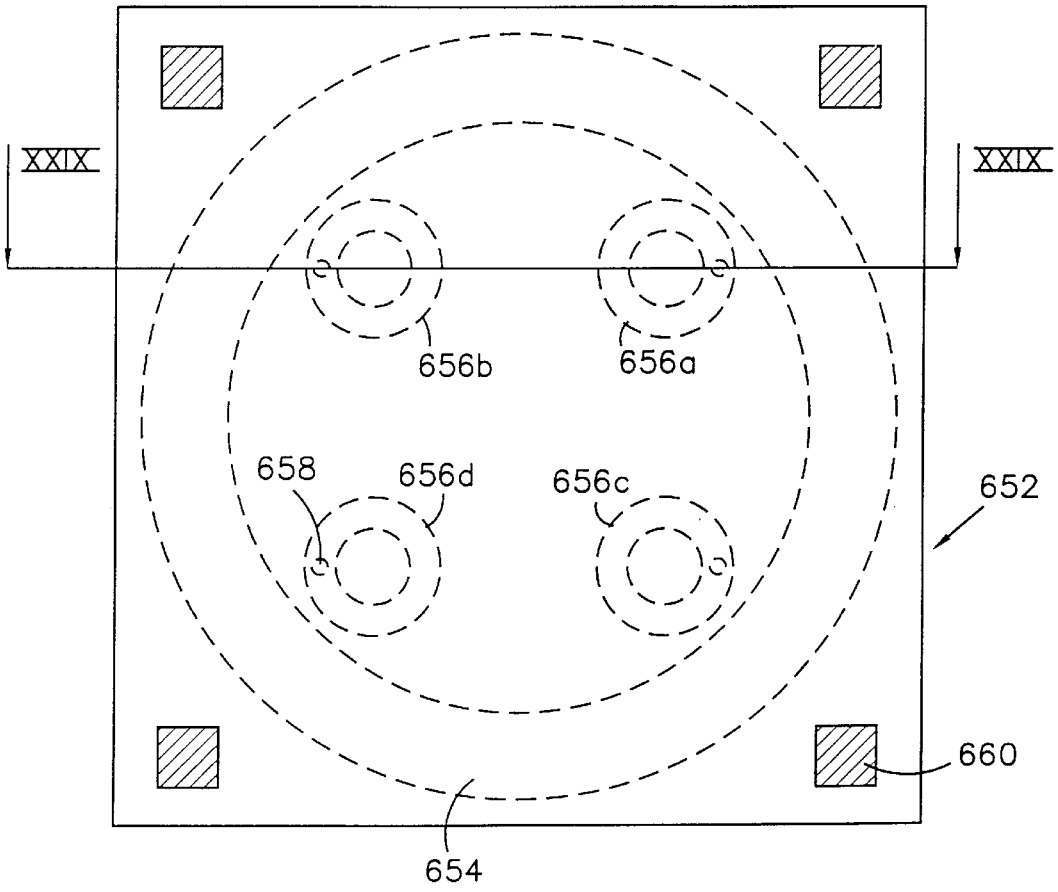
FIG. 28 is a simplified illustration of a chair support platform useful in the apparatus of FIG. 27 and employing an air cushion assembly constructed and operative in accordance with a preferred embodiment of the present invention.

Reference is now made to FIG. 28 which illustrates a preferred embodiment of platform 652. The platform 652 includes at its underside an outer enclosure member 654, which may be of the same general construction as enclosure member 602, described hereinabove. In accordance with a preferred embodiment of the invention, a plurality of additional inner enclosure members 656*a*, 656*b*, 656*c* and 656*d* may be disposed interiorly of enclosure member 654 on the underside of platform 652. Inner enclosure members 656 are normally of a smaller diameter (in cross section) than that of outer enclosure member 654 and thus normally do not contact a support surface other than when the center of mass of a load applied to the platform 652 is off center by at least a predetermined amount.

In the illustrated embodiment, pressurized air is supplied via inlets 658 to the inner enclosure members 656. Alternatively, the pressurized air may be supplied to the interior of outer enclosure member 654 or to another location within outer enclosure member 654.

The platform 652 may additionally have a plurality of recesses 660 for accommodating the legs of chair 650.

Figure 29:
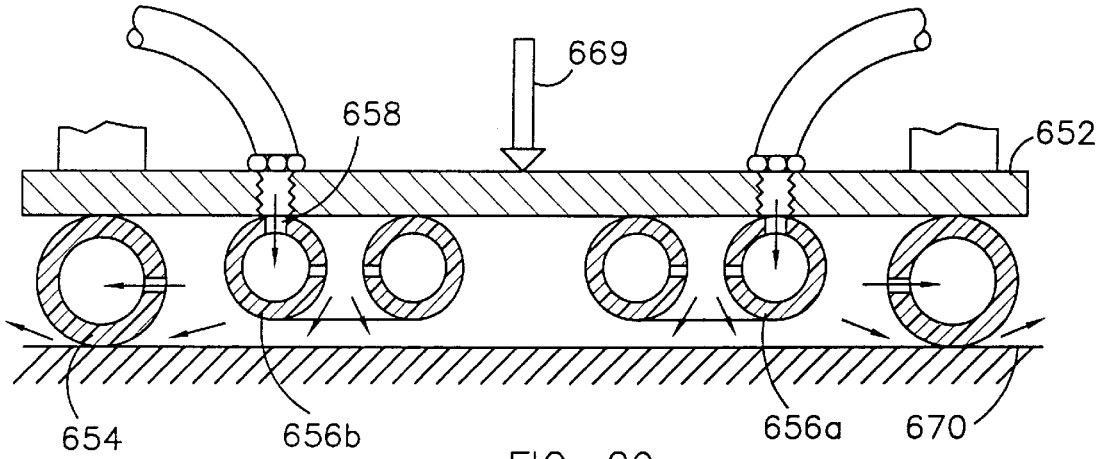
FIGS. 29 and 30 are simplified sectional illustrations taken at lines XXIX—XXIX in FIG. 28, which illustrate operation of the assembly of FIG. 28 under respective balanced load and unbalanced load conditions.
Figure 30:
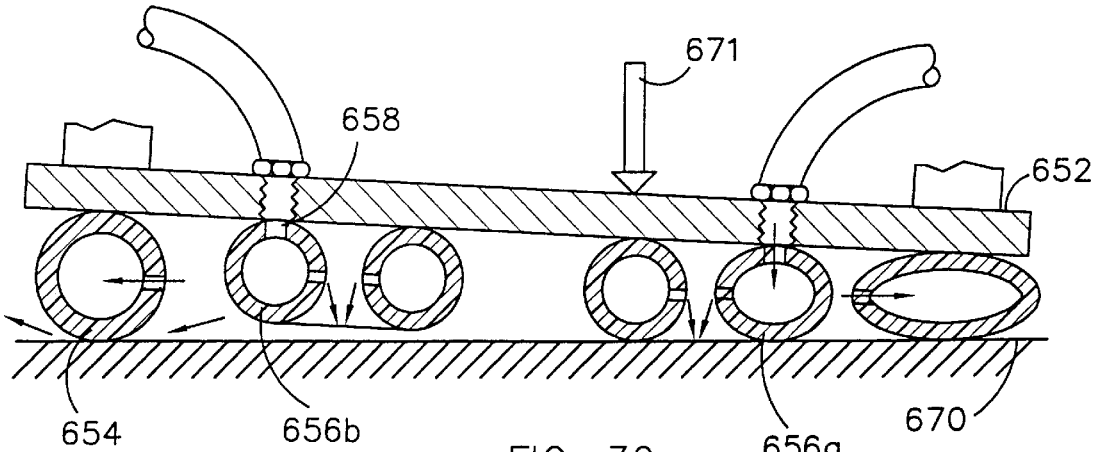

The structure and operation of the apparatus of FIGS. 27 and 28 will be understood more clearly from a consideration of FIGS. 29 and 30. FIG. 29 illustrates a situation wherein the center of mass of the load on platform 652 is generally at the center of the platform, as indicated by arrow 669. Here it is seen that the inner enclosure members 656*a* and 656*b* (and also 656*c* and 656*d*, not shown in FIG. 29) do not contact a support surface 670 and that pressurized air supplied to inner enclosure members 656*a* and 656*b* (and also 656*c* and 656*d*, not shown in FIG. 29) inflate both the inner and outer enclosure members and provides a low friction air cushion between the outer enclosure member 654 and the support surface 670. The air pressure at all locations within outer enclosure member 654 is generally equal.

FIG. 30 illustrates a situation wherein the center of mass of the load on platform 652 is off-center with respect to the center of the platform, as indicated by arrow 671. Here it is seen that some of the inner enclosure members, such as 656*a*, contact support surface 670 and that pressurized air supplied to inner enclosure member 656*b* inflates both the inner and outer enclosure members and provides a low friction air cushion between the outer enclosure member 654 and the support surface 670.

As distinct from the situation shown in FIG. 29, here in FIG. 30, the air pressures are not all uniform throughout the interior of enclosure member 654. Interiorly of those of inner enclosure members, such as 656*a*, which contact the support surface 670, a somewhat higher pressure is maintained than is present elsewhere interior of outer enclosure members 654. This provides enhanced lifting force to that portion of the platform which receives the greatest load and helps to ensure that notwithstanding uneven loading of the platform, a low-friction air-cushion is maintained at all locations thereat, to permit relatively free sliding motion of the platform relative to the support surface 670.

Reference is now made to FIGS. 31–34 which illustrate the use of yet another preferred embodiment of air cushion mechanism constructed and operative in accordance with a preferred embodiment of the present invention.

Figure 31:
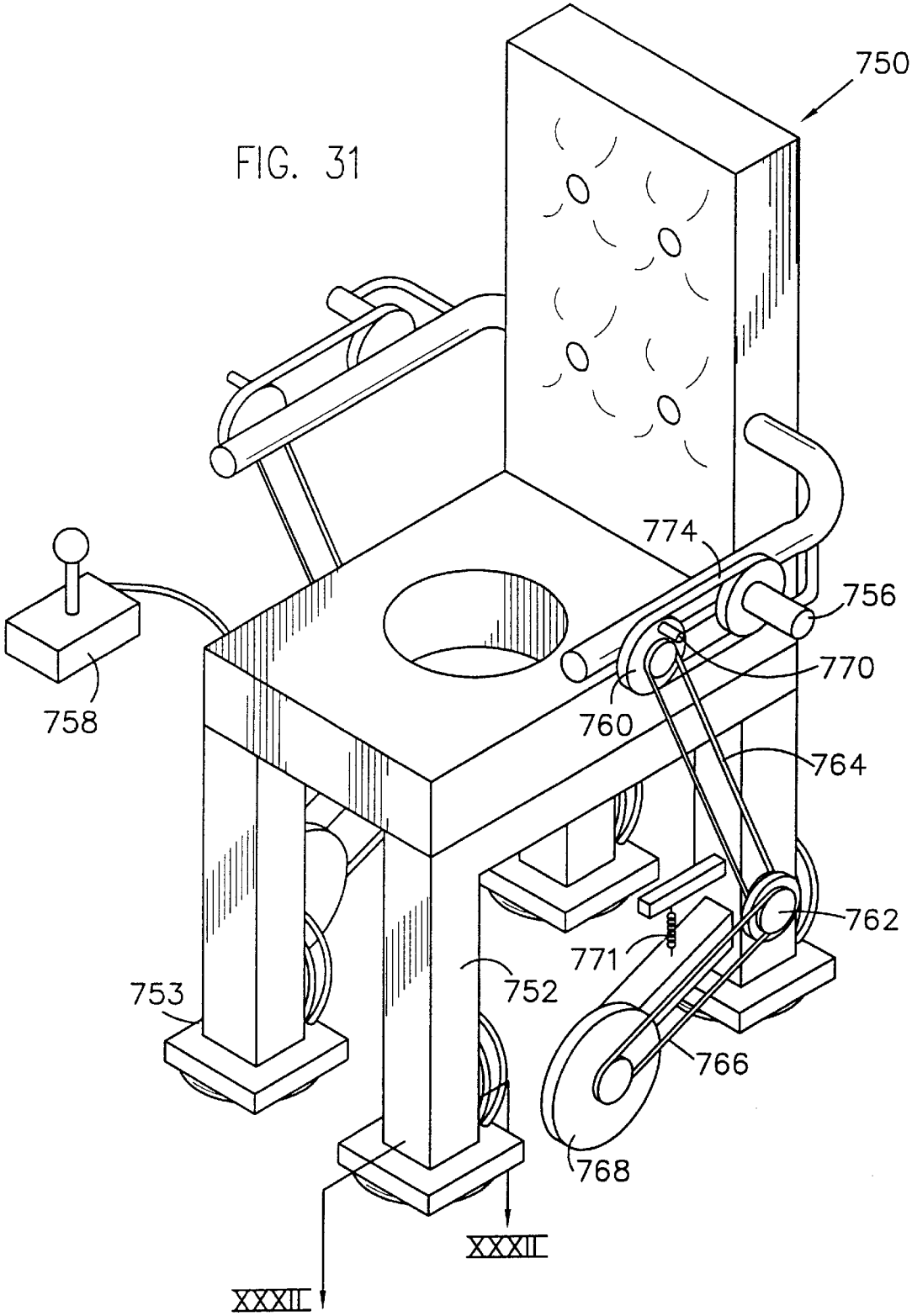
FIG. 31 is an illustration of a special purpose chair employing air cushion mechanisms of the general type illustrated in FIGS. 21–27.

FIG. 31 is an illustration of a driver-equipped chair 750 employing air cushion mechanisms of the general type illustrated in FIGS. 21–26. Each leg 752 of the chair is supported on an air cushion platform 753. Mounted on the chair 750 is a driving mechanism 774, which may be employed for displacing the chair 750 along a support surface.

The chair 750 includes two identical drive mechanisms located on the right-hand side and left-hand side of the chair (relative to the patient).The left-hand driving mechanism 774 typically comprises a motor 756 operated by a joystick control unit 758 and providing an output via pulleys 760 and 762 and belts 764 and 766 to a drive wheel 768, frictionally engaging the support surface. Alternatively or additionally, the driving mechanism may comprise a hand crank 770, connected to pulley 770 for manual drive. Spring 771 ensures contact between the drive wheel 768 and the support surface.

The chair may be configured to be used to position a patient over a toilet or for any other suitable purpose.

Figure 32:
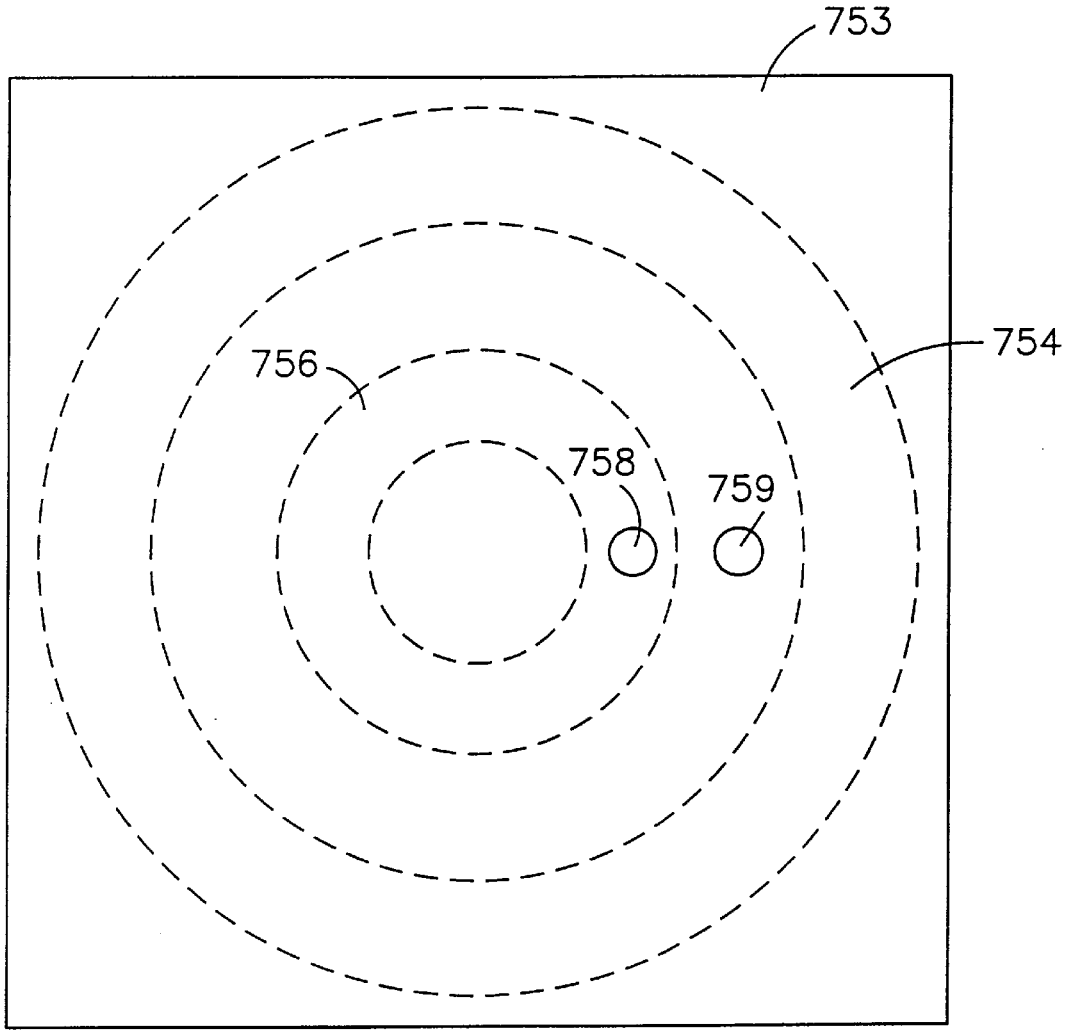
FIG. 32 is an illustration of the underside of a leg support platform forming part of the apparatus of FIG. 31.

Reference is now made to FIG. 32 which illustrates a preferred embodiment of platform 753. The platform 753 includes at its underside an outer enclosure member 754, which may be of the same general construction as enclosure member 602, described hereinabove. In accordance with a preferred embodiment of the invention, an inner enclosure member 756 is disposed interiorly of enclosure member 754 and coaxially therewith on the underside of platform 753. Inner enclosure member 756 is normally of a smaller diameter (in cross section) than that of outer enclosure member 754 and thus normally does not contact a support surface 770 other than when the loading of platform 753 is greater than a predetermined amount or is not centered by at least a predetermined amount.

In the illustrated embodiment, pressurized air is supplied via inlets 758 to the inner enclosure member 756. The pressurized air may be supplied to a plurality of inlets 759 of inner enclosure members 756, of legs 752, through a plurality of conduits 761. Conduits 761 connect together inlets 759 of each leg 752 and may be alternatively connected to a pressure manifold (not shown). Additionally, pressurized air may be supplied advantageously to a location between the inner enclosure member 756 and the outer enclosure member 754 via an inlet 759.

Figure 33:
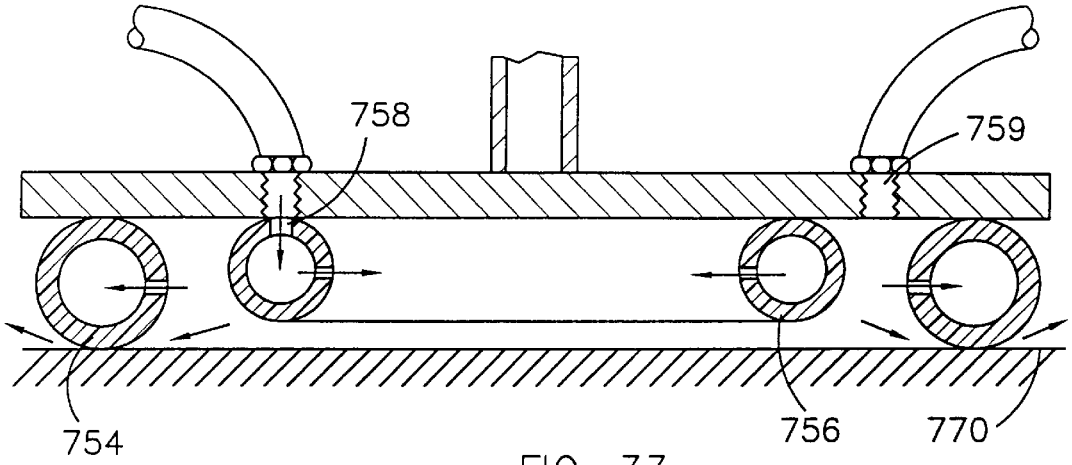
FIGS. 33 and 34 are simplified sectional illustrations taken at lines XXXIII—XXXIII in FIG. 31, which illustrate operation of the assembly of FIGS. 31 and 32 under respective relatively low and relatively high load conditions.
Figure 34:
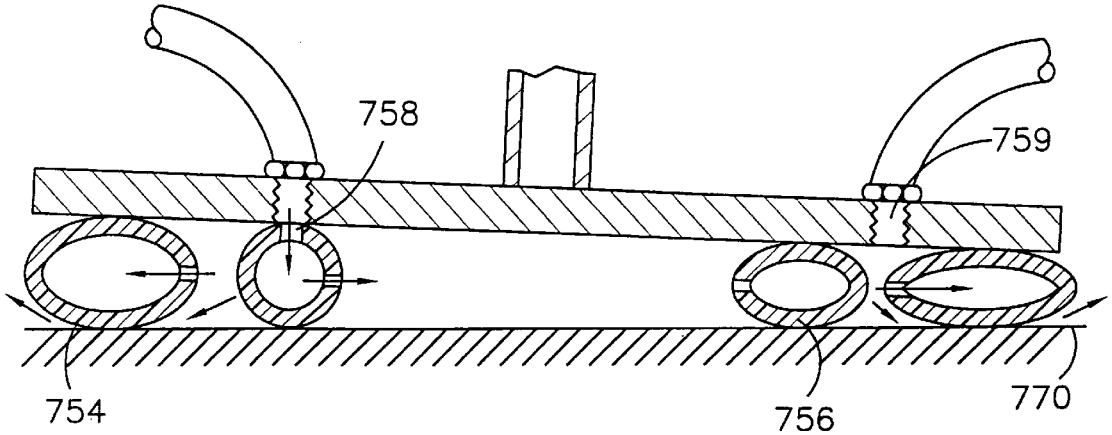

The structure and operation of the apparatus of FIGS. 31 and 32 will be understood more clearly from a consideration of FIGS. 33 and 34. FIG. 33 illustrates a situation wherein a relatively small load is applied to platform 753. Here it is seen that the inner enclosure member 756 does not contact a support surface 770 and that pressurized air supplied to inner enclosure member 756 inflates both the inner and outer enclosure members and provides a low friction air cushion between the outer enclosure member 754 and the support surface 770. The air pressure at all locations within outer enclosure member 754 is generally equal.

FIG. 34 illustrates a situation where a relatively large load is applied to platform 753. Here it support surface 770 and that pressurized air supplied to inner enclosure member 756 inflates both the inner and outer enclosure members and provides a low friction air cushion between the outer and inner enclosure members and the support surface 770.

As distinct from the situation shown in FIG. 33, here the air pressures are not all uniform throughout the interior of enclosure member 754. Interiorly of inner enclosure member 756 which contacts the support surface, a somewhat higher pressure is maintained than is present under platforms which are loaded to a lesser degree. This provides enhanced lifting force to the platforms 753 which receive the greatest load and helps to ensure that notwithstanding uneven loading of the chair 750, a low-friction air-cushion is maintained at each of the legs thereof, to permit relatively free sliding motion of the chair relative to the support surface 770. Reference is now made to FIGS. 35–38 which illustrate the use of yet another preferred embodiment of air cushion mechanism constructed and operative in accordance with a preferred embodiment of the present invention.

Figure 35:
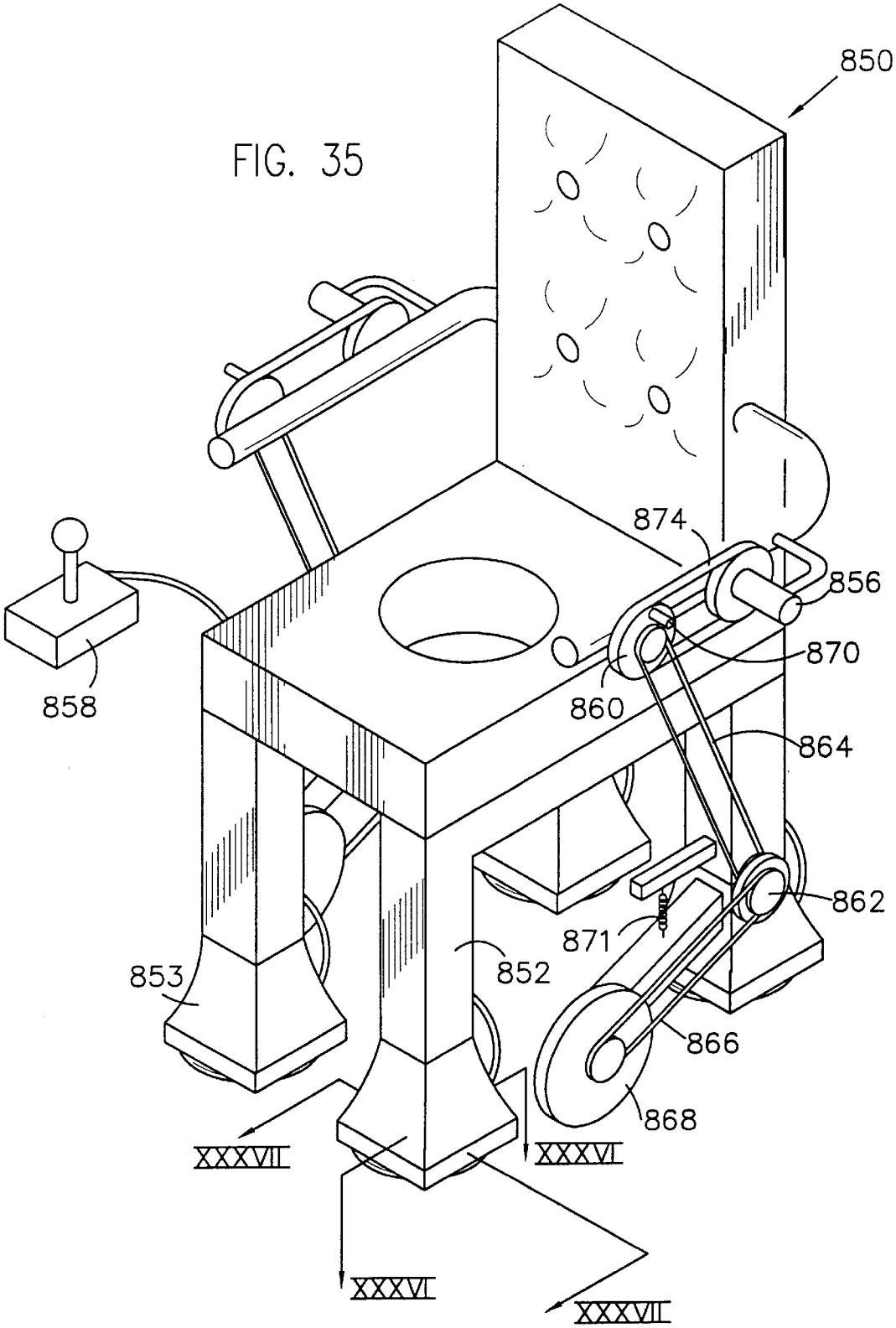
FIG. 35 is an illustration of a special purpose chair similar to that of FIG. 31 but employing an alternative embodiment of air cushion mechanism.

FIG. 35 is an illustration of a driver-equipped chair 850 employing air cushion mechanisms constructed and operative in accordance with a preferred embodiment of the present invention. Each leg 852 of the chair is supported on an air cushion platform 853. Mounted on the chair 850 is a driving mechanism 874, which may be employed for displacing the chair 850 along a support surface.

The chair 850 includes two identical drive mechanisms located on the right-hand side and the left-hand side of the chair (relative to the patient). The left-hand driving mechanism 874 typically comprises a motor 856 operated by a joystick control unit 858 and providing an output via pulleys 860 and 862 and belts 864 and 866 to a drive wheel 868, frictionally engaging the support surface. Alternatively or additionally, the driving mechanism may comprise a hand crank 870 connected to pulleys 860 and 862 for manual drive. Spring 871 ensures that there is contact between the drive wheel 868 and the support surface.

The chair may be configured to be used to position a patient over a toilet or for any other suitable purpose.

Figure 36:
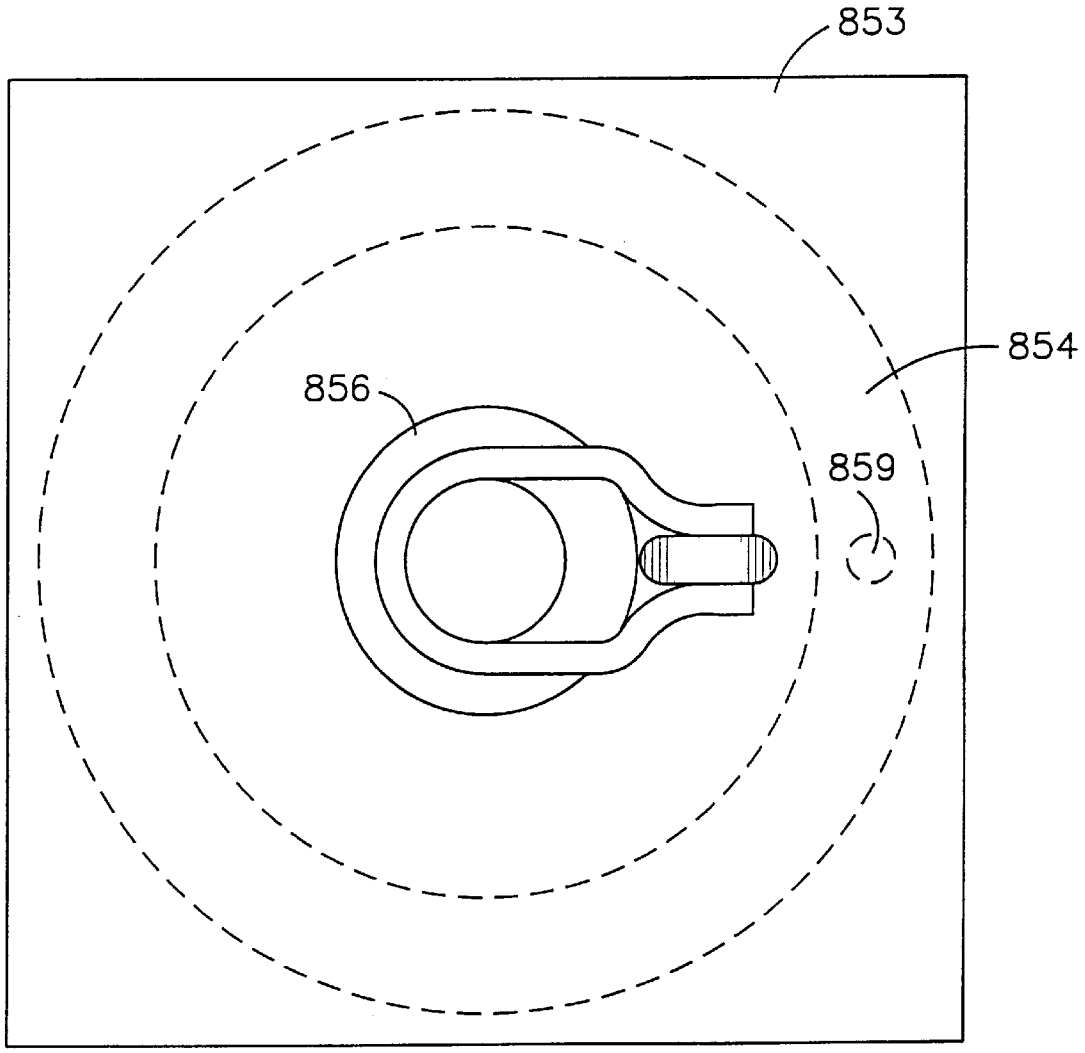
FIG. 36 is an illustration of the underside of a leg support platform forming part of the apparatus of FIG. 35.
Figure 37:
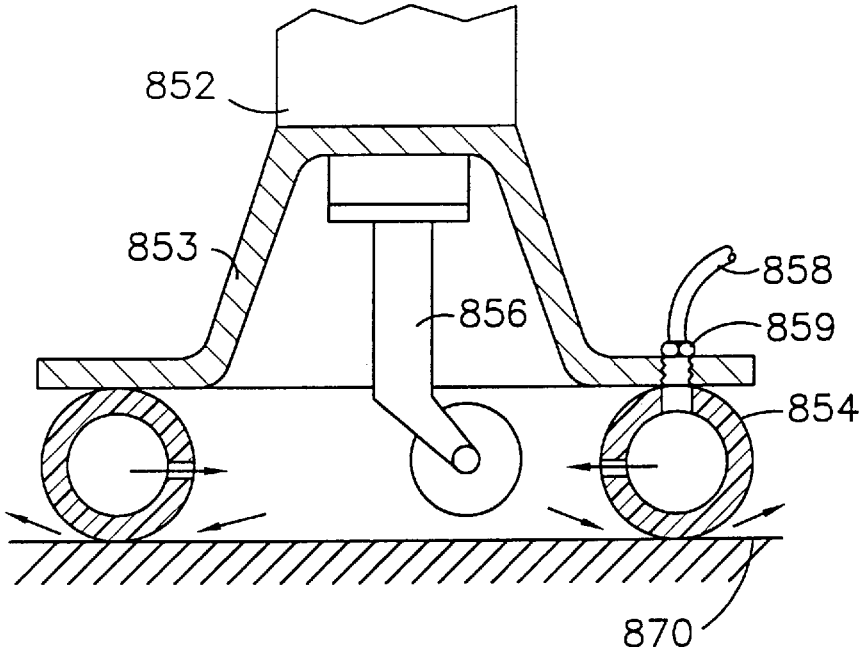
FIGS. 37 and 38 are simplified sectional illustrations taken at lines XXXVII—XXXVII in FIG. 35, which illustrate operation of the assembly of FIGS. 35 and 36 under respective relatively low and relatively high load conditions.
Figure 38:
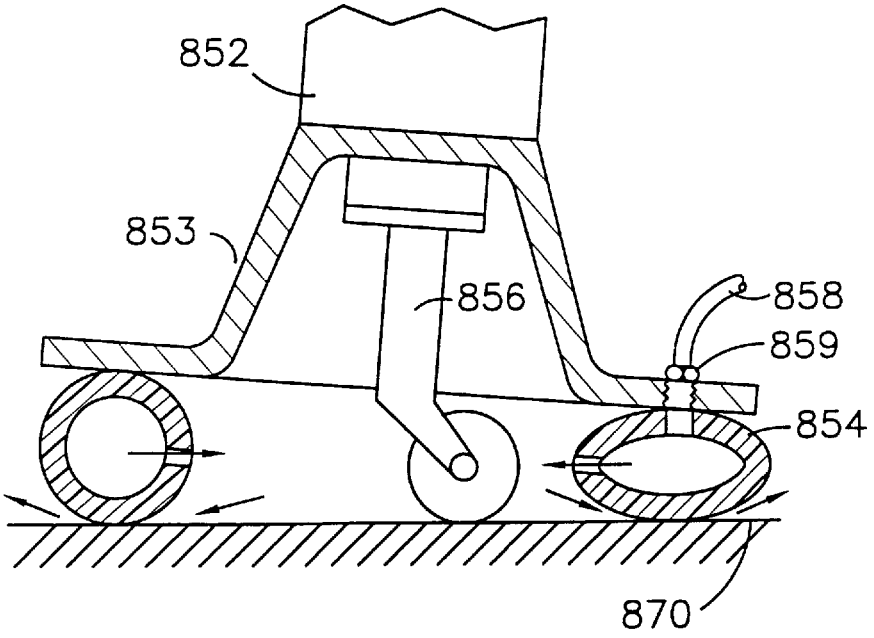

Reference is now made to FIGS. 36–38 which illustrate a preferred embodiment of platform 853. The platform 853 typically has a bell-shaped configuration and includes at its underside rim surface an enclosure member 854, which may be of the same general construction as enclosure member 602, described hereinabove.

In accordance with a preferred embodiment of the invention, a castor assembly 856 is disposed interiorly of platform 853 and centrally with respect thereto. Alternatively, the castor assembly may be disposed exteriorly to the platform 853. Castor assembly 856 is normally positioned such that it does not contact a support surface when the enclosure member 854 is fully inflated. When the enclosure member 854 is wholly or partially uninflated, due in whole or in part to uneven loading of the chair or lack of sufficient pressurization for any reason, the castor assembly 856 supports the chair leg 852.

In the illustrated embodiment, pressurized air is supplied via a conduit 858 and an inlet 859 to the interior of enclosure member 854. FIG. 37 illustrates a situation wherein a relatively small load is applied to platform 853. Here it is seen that the caster wheel 856 assembly does not contact a support surface 870 and that pressurized air supplied to enclosure member 854 inflates the enclosure member and provides a low-friction air cushion between the enclosure member 854 and the support surface. The air pressure at all locations of enclosure member 854 is generally equal.

FIG. 38 illustrates a situation where a relatively large load is applied to platform 853. Here it is seen that the castor assembly 856 does contact support surface 870 and at least partially supports the chair.

Figure 39:
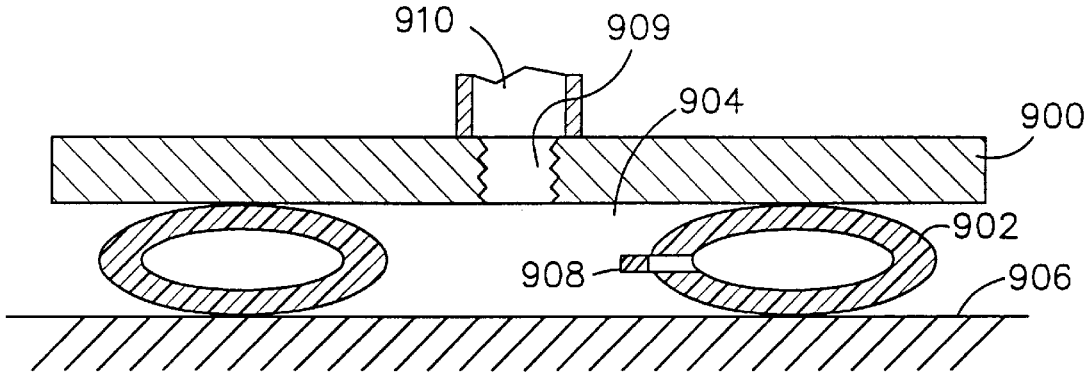
FIGS. 39 and 40 illustrate part of a further embodiment of the apparatus of FIG. 21.
Figure 40:
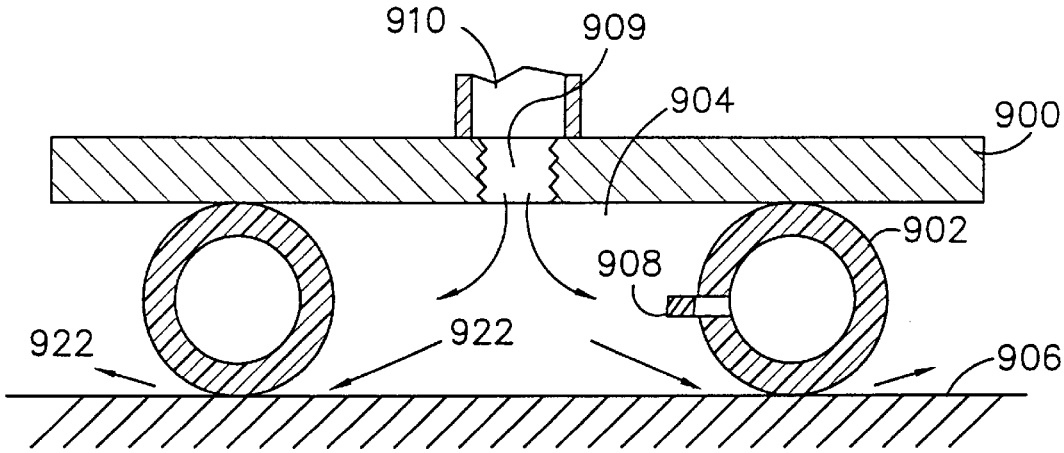

Reference is now made to FIGS. 39 and 40, which illustrate an alternative embodiment of the apparatus shown in FIGS. 22 and 23. A base member 900 supports a lifting assembly, part of which is shown at reference numeral 601 (FIG. 21).

Mounted on the underside of base member 900 are a plurality of inflatable enclosure members 902, each of which encloses a volume 904 located between the underside of base member 900 and a support surface 906. Preferably, the enclosure members 902 are somewhat resilient and may he formed of flexible plastic or rubber.

In accordance with a preferred embodiment of the invention, each enclosure member 902 is provided with a sealable aperture 908, which preferably includes an air valve 902, which allows the inflation of enclosure 902 prior to operation of the air cushion mechanism, with an air pressure such as 0.3 bar.

Pressurized air conduits 910 communicating with the enclosure volume 904 are supplied with pressurized air via a manifold 612 (FIG. 21) with which may be associated pressure or flow limiting devices (not shown).

It is seen that in the absence of the supply of pressurized air to the volume 904, as seen in FIG. 39, enclosure member

902 is partially compressed and provides a relatively large surface area in contact with the support surface 906. No air cushion is provided, and thus, the base member 900 does not tend to slide along the support surface 906.

When pressurized air is supplied to volume 904, this reduces the surface area of enclosure member 902 which is in contact with the support surface 906 and provides a flow of air, indicated generally by arrows 922, which passes between the underside of enclosure member 902 and the support surface 906, thereby providing an air cushion and permitting the base member 900 to slide relative to the support surface 906.

It will be appreciated by persons skilled in the art that the present invention is not limited by what has been particularly shown and described hereinabove. Rather the scope of the present invention is defined only by the claims which follow:

I claim:

1. Patient support apparatus comprising:

a movable base which translates along a support surface in response to motion of a patient;

a patient support assembly mounted on the movable base; and a displacement limiter operative to limit a vertical displacement of the patient support assembly in at least one direction, and wherein said movable base includes an air cushion generator for generating an air cushion for low friction engagement with a support surface.

2. Patient support apparatus comprising:

a patient support assembly;

a winch assembly for vertically displacing the patient support assembly, said winch assembly comprising:

a cable which extends over a pulley mounted on a portion of said patient support assembly;

a secondary cable which extends over another pulley mounted on another portion of said patient support assembly;

first and second winding drums; and a pair of cable winding assemblies which are operative to wind said cable and said secondary cable onto said first and second winding drums, respectively;

and yieldable force application apparatus operatively connected to said cable winding assemblies for winding said cable and said secondary cable onto said first and second winding drums, respectively, so as to apply a restraining force to the patient support assembly.

3. Patient support apparatus according to claim 2 and wherein said yieldable force application apparatus is operative to cause said cable winding assemblies to maintain a desired vertical position of the patient support assembly, notwithstanding variations in the vertical tension applied said patient support assembly.

4. Patient support apparatus according to claim 2 and wherein said yieldable force application apparatus is operative to cause said cable winding assemblies to apply a desired vertical tension to the patient support assembly, notwithstanding variations in the vertical displacement applied said patient support assembly.

5. Patient support apparatus according to claim 2 and wherein said yieldable force application apparatus is operative to cause said cable winding assemblies to apply a variable vertical tension said patient support assembly as a function of the vertical position thereof within selectable limits.

6. Patient support apparatus according to claim 2 and wherein said yieldable force application apparatus is operative to cause said cable winding assemblies to periodically raise and lower the patient support assembly in a selectably preprogrammed manner, as for providing exercise to particular parts of a patient's body.

7. Patient support apparatus according to claim 2 and wherein said yieldable force application apparatus is operative to cause said cable winding assemblies to periodically apply a vertical force to the patient support assembly in a selectably preprogrammed manner, as for providing exercise to particular parts of a patient's body.

* * * * *